US007997209B2

(12) United States Patent
Kereth

(10) Patent No.: US 7,997,209 B2
(45) Date of Patent: Aug. 16, 2011

(54) PROPULSION MECHANISM

(76) Inventor: Yefim Kereth, Rehovot (IL)

( * ) Notice: Subject to any disclaimer, the term of this patent is extended or adjusted under 35 U.S.C. 154(b) by 472 days.

(21) Appl. No.: 11/988,615

(22) PCT Filed: Jul. 10, 2006

(86) PCT No.: PCT/IL2006/000799

§ 371 (c)(1),
(2), (4) Date: Jan. 11, 2008

(87) PCT Pub. No.: WO2007/007328

PCT Pub. Date: Jan. 18, 2007

(65) Prior Publication Data

US 2009/0126597 A1 May 21, 2009

(30) Foreign Application Priority Data

Jun. 14, 2006 (IL) ..... 176302

(51) Int. Cl.
*B61B 9/00* (2006.01)
*B62D 55/00* (2006.01)
*F16C 15/00* (2006.01)

(52) U.S. Cl. ..... 104/165; 180/9.42; 74/572.2

(58) Field of Classification Search ..... 105/49, 105/50, 52–54, 148; 180/9.42; 74/572.2; 475/220; 104/165, 162, 163, 166–168
See application file for complete search history.

(56) References Cited

U.S. PATENT DOCUMENTS

| | | | | |
|---|---|---|---|---|
| 4,768,090 | A | 8/1988 | Camps et al. | |
| 6,085,368 | A * | 7/2000 | Robert et al. | 5/85.1 |
| 6,339,448 | B1 | 1/2002 | Patrick | |
| 6,516,728 | B1 * | 2/2003 | Muller et al. | 104/94 |
| 6,805,226 | B1 * | 10/2004 | Ross et al. | 191/45 A |
| 2010/0065347 | A1 * | 3/2010 | Kereth | 180/9.42 |

FOREIGN PATENT DOCUMENTS

| | | |
|---|---|---|
| DE | 3247491 | 11/1983 |
| DE | 4436519 | 4/1996 |
| GB | 2277069 | 10/1994 |

* cited by examiner

*Primary Examiner* — Joe Morano, IV
*Assistant Examiner* — Robert McCarry, Jr.
(74) *Attorney, Agent, or Firm* — Stetina Brunda Garred & Brucker

(57) ABSTRACT

There is provided a differential propulsion mechanism including two or more concentric and mutually counter-rotating first wheels (4, 6, 8, 10), mutually reacting and balancing the torque of a motor drive (20) interacting with the wheels. The motor drive has a stator attached to one of the first wheels to power a first wheel over a first track (12, 14, 16, 18), a rotor coupled to a mechanical link, at least indirectly connecting the rotor with a second of the two or more first wheels to power the second wheel over a second track, and a concentric connecting device affixed for coupling a payload thereto or for coupling the mechanism itself to another device.

12 Claims, 25 Drawing Sheets

PROPULSION MECHANISM

FIELD OF THE INVENTION

The present invention relates to a light-weight unmanned vehicle, carrying sensors and/or payloads over long lines of flexible and/or rigid tracks, installed over, or attached to structures, sites and facilities. The invention provides a cost-effective solution for mobility power and communication of payloads, over short and long lines over structures, sites and facilities in indoor and/or outdoor applications.

BACKGROUND OF THE INVENTION

There is a need for different types of dedicated unmanned sensors/payloads, e.g., day cameras, thermal imagers, laser imagers, acoustic sensors, chemical sensors, etc., to be transported in a fast, reliable and cost-effective way over long lines of structures, sites and facilities. Sometimes, unmanned payloads have to be carried to barely reachable or extremely dangerous areas to monitor remote events and/or activities. In other cases, unattended payloads have to be repeatedly transported over long lines in a cost effective way.

From an economical point of view, expensive payloads having vast capabilities, e.g., surveillance equipment, may not be cost-effective in a stationary deployment. Given a cost-effective transportation solution, however, it may become more economical for the payloads to be dynamically deployed or deployed on a time-sharing basis.

This present invention provides a cost-effective solution for mobility, power and communication of platforms and payloads remotely operated over long lines of structures, sites and facilities in indoor and/or outdoor applications.

SUMMARY OF THE INVENTION

It is therefore a broad object of the present invention to deploy in a dynamic and a cost-effective way dedicated payloads over structures, sites and facility lines.

In accordance with the present invention there is therefore provided a differential propulsion mechanism comprising two or more concentric and mutually counter-rotating first wheels, mutually reacting and balancing the torque of a motor drive interacting with said wheels, said motor drive having a stator attached to one of said first wheels to power a first wheel over a first track, said motor drive having a rotor coupled to a mechanical link, at least indirectly connecting said rotor with at least one second of said two or more first wheels to power said second wheel over a second track, and a concentric connecting device affixed for coupling a payload thereto or for coupling the mechanism itself to another device.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic view of a simplified electro-mechanical principle of the mechanism of a platform module, according to the present invention;

FIG. 2 is a schematic view of a simplified diagram of a power supply and control for the platform module of FIG. 1;

Figure 3A:
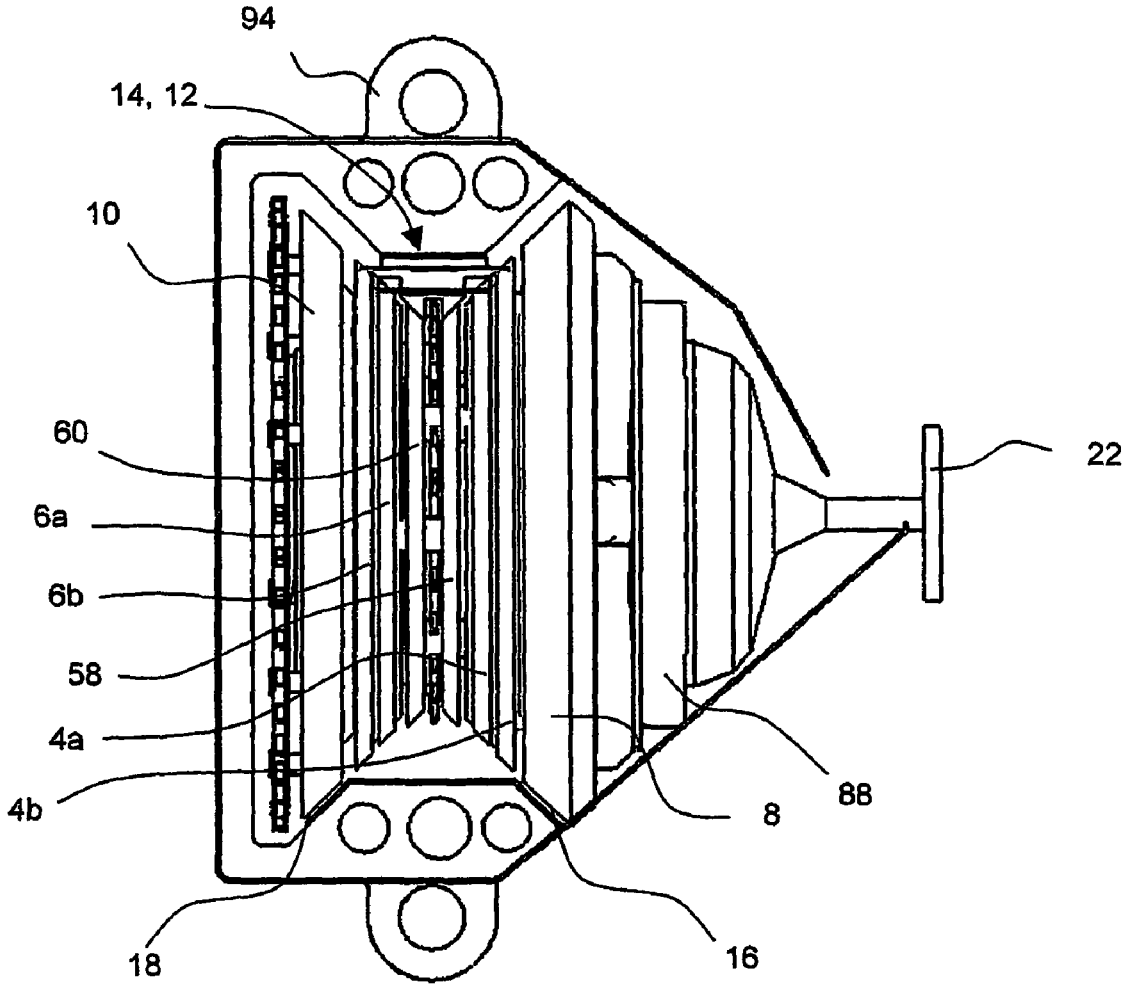
Figure 3B:
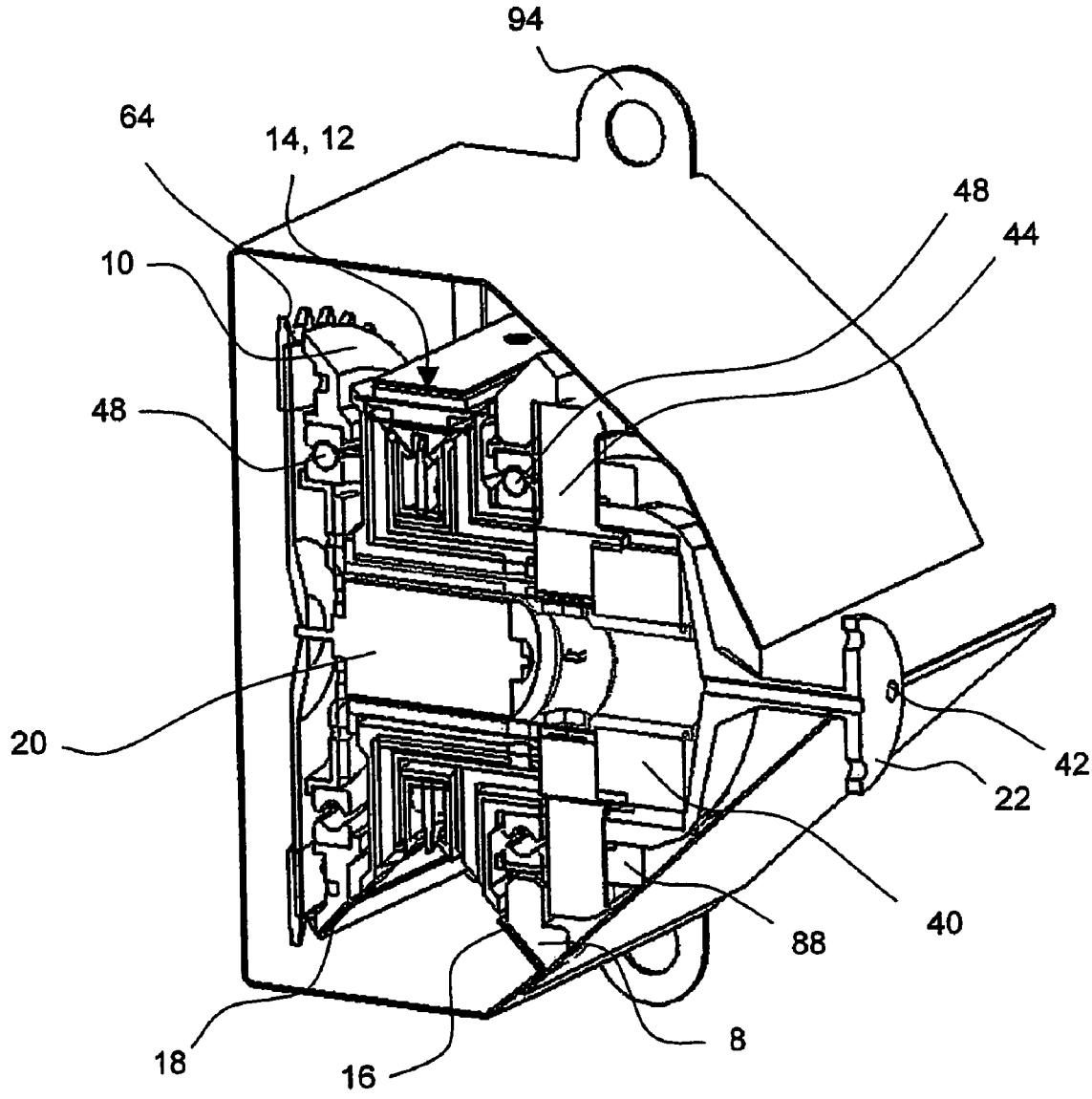
Figure 3C:
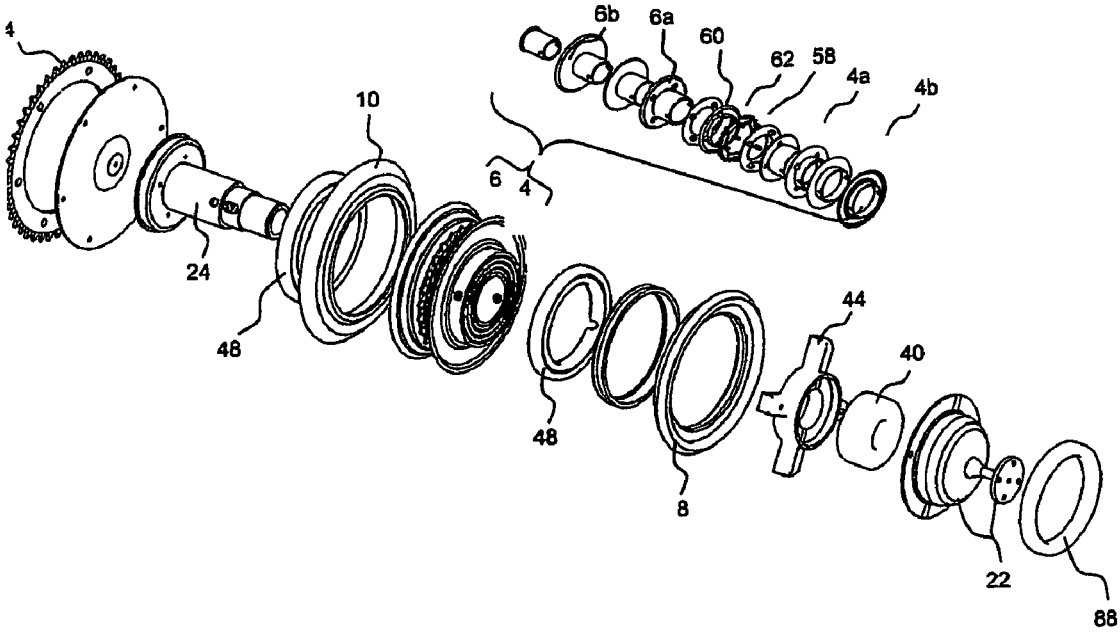
Figure 4A:
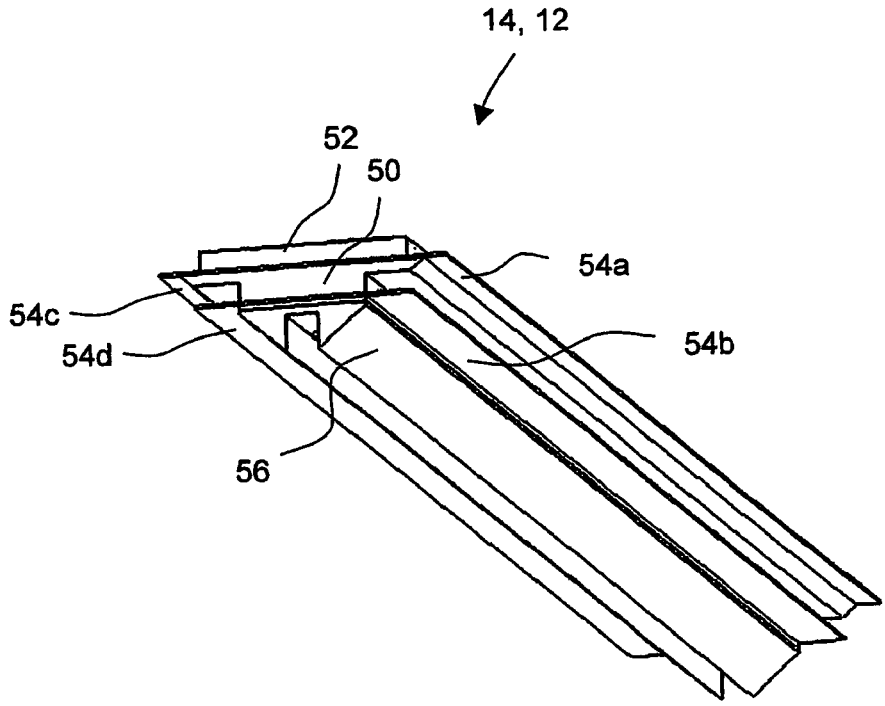
Figure 4B:
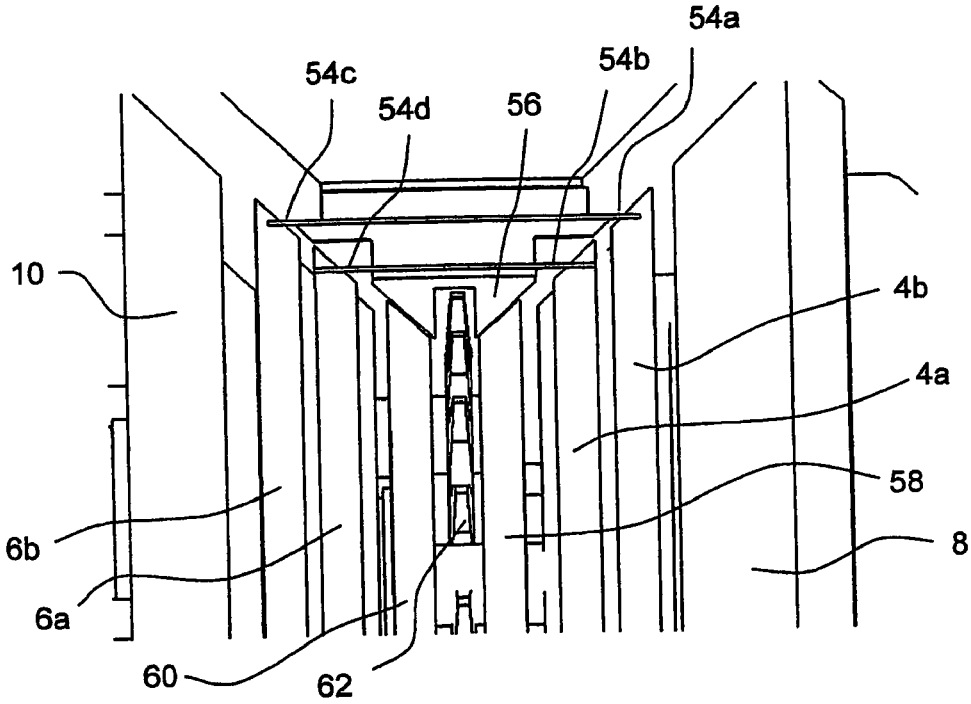
Figure 6A:
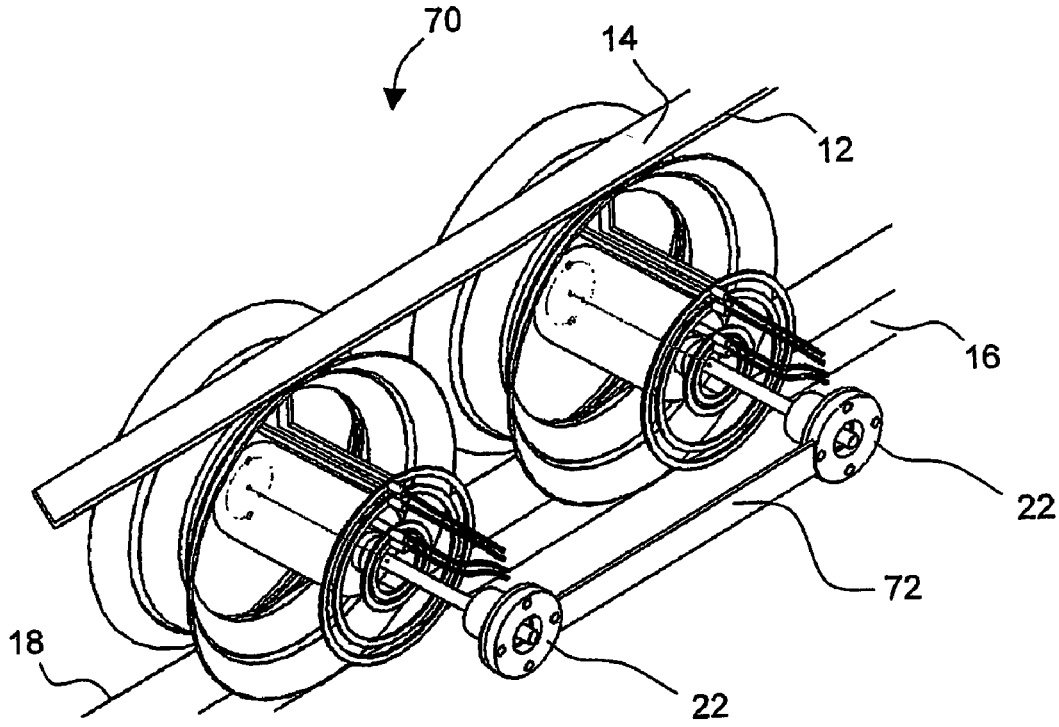
Figure 6B:
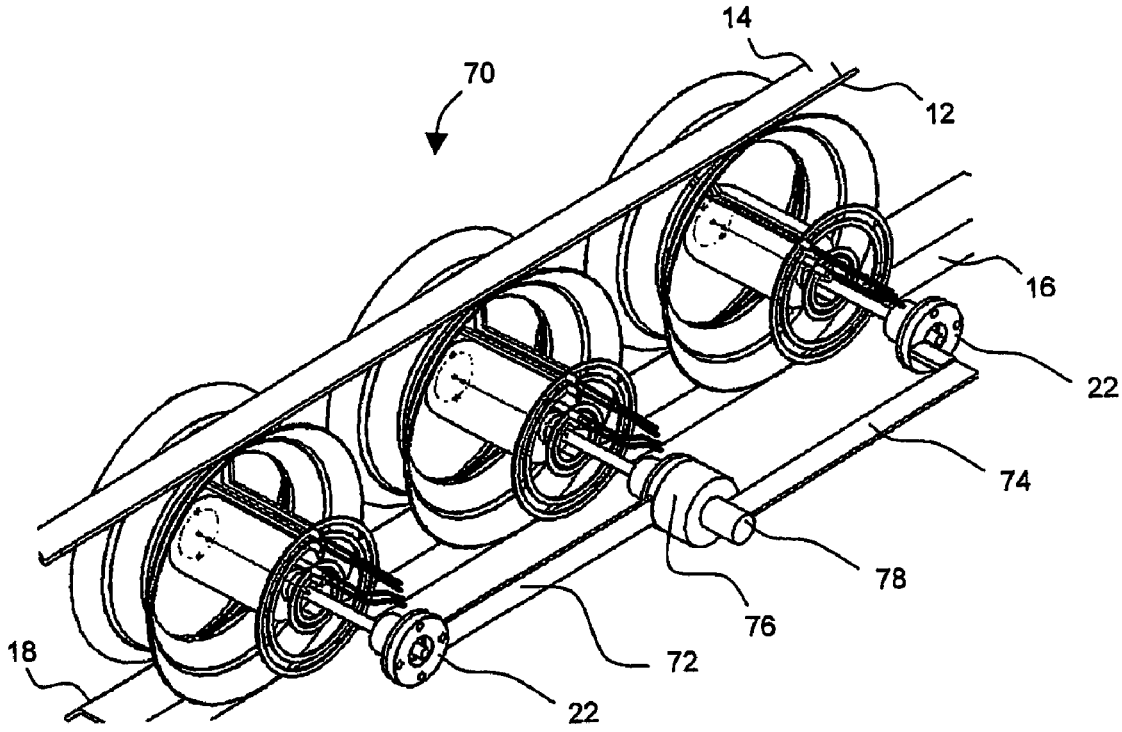
Figure 7A:
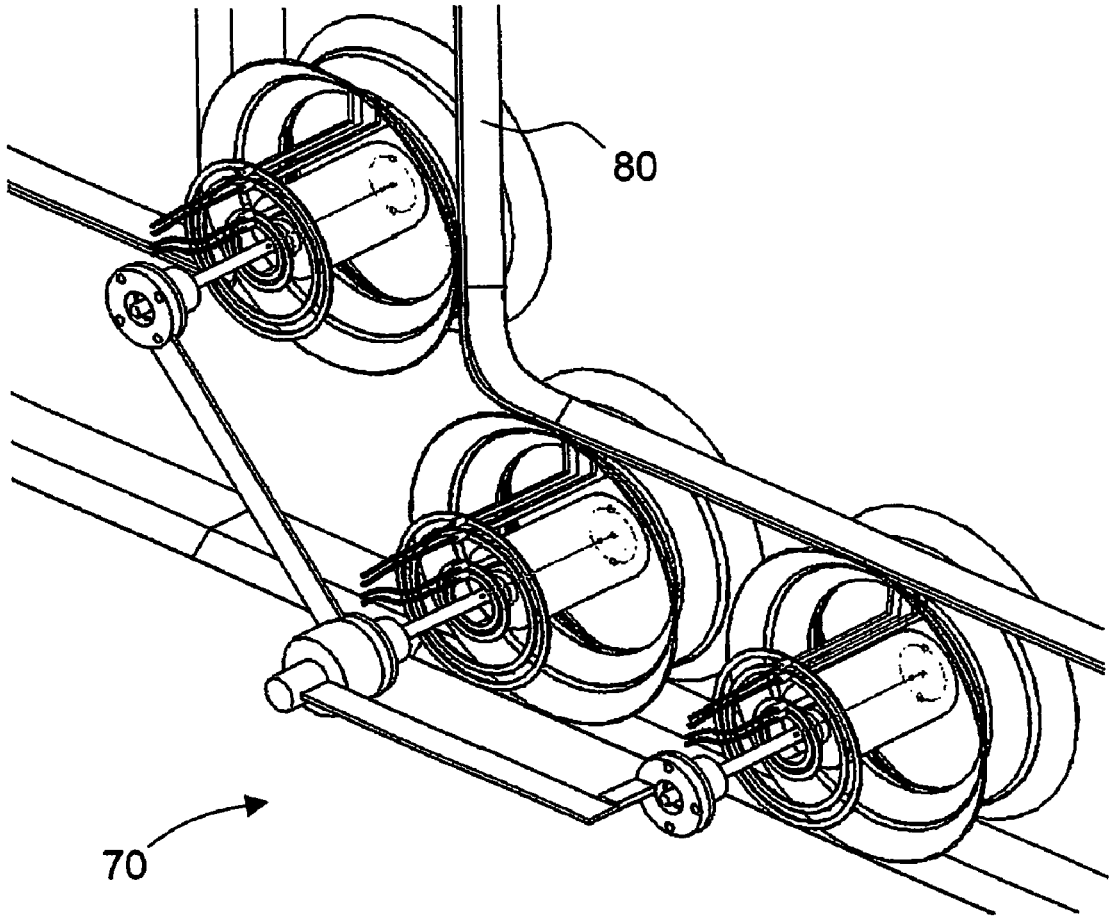
Figure 7B:
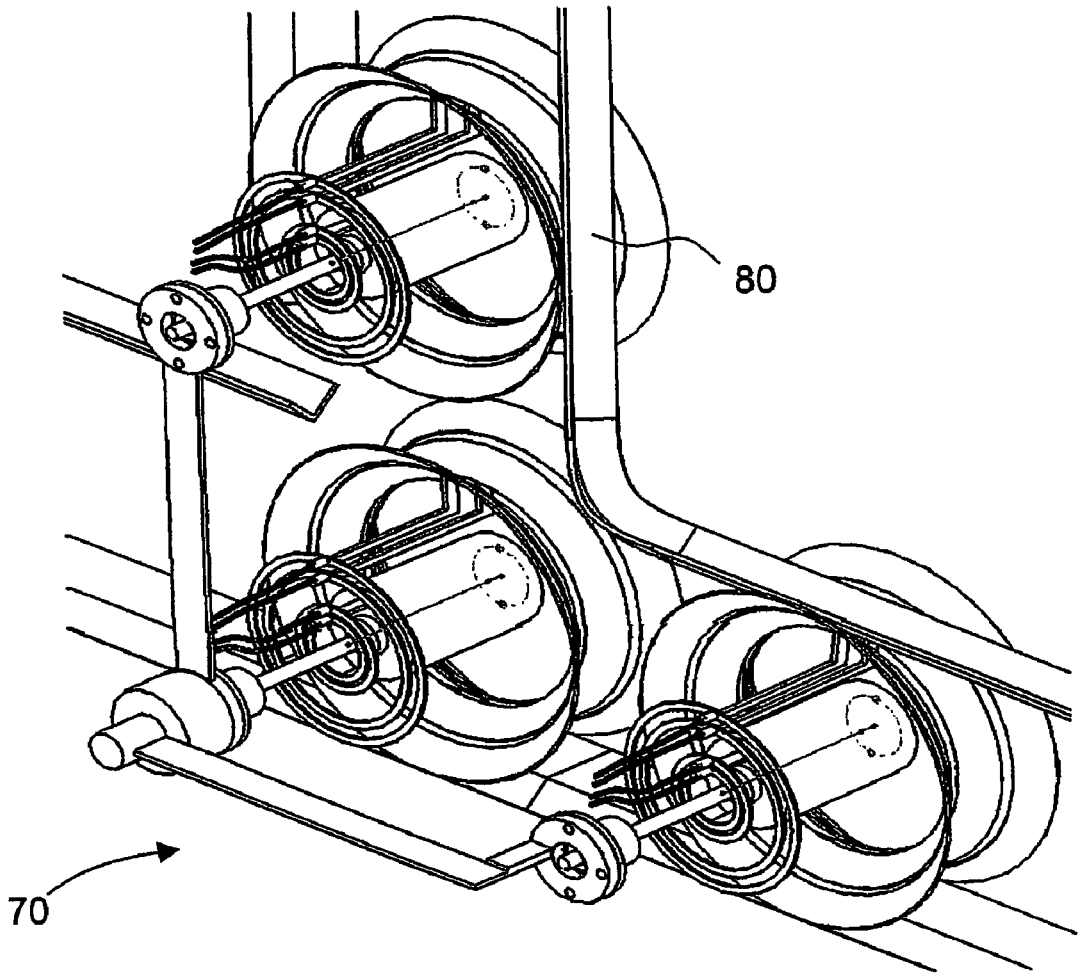
Figure 7C:
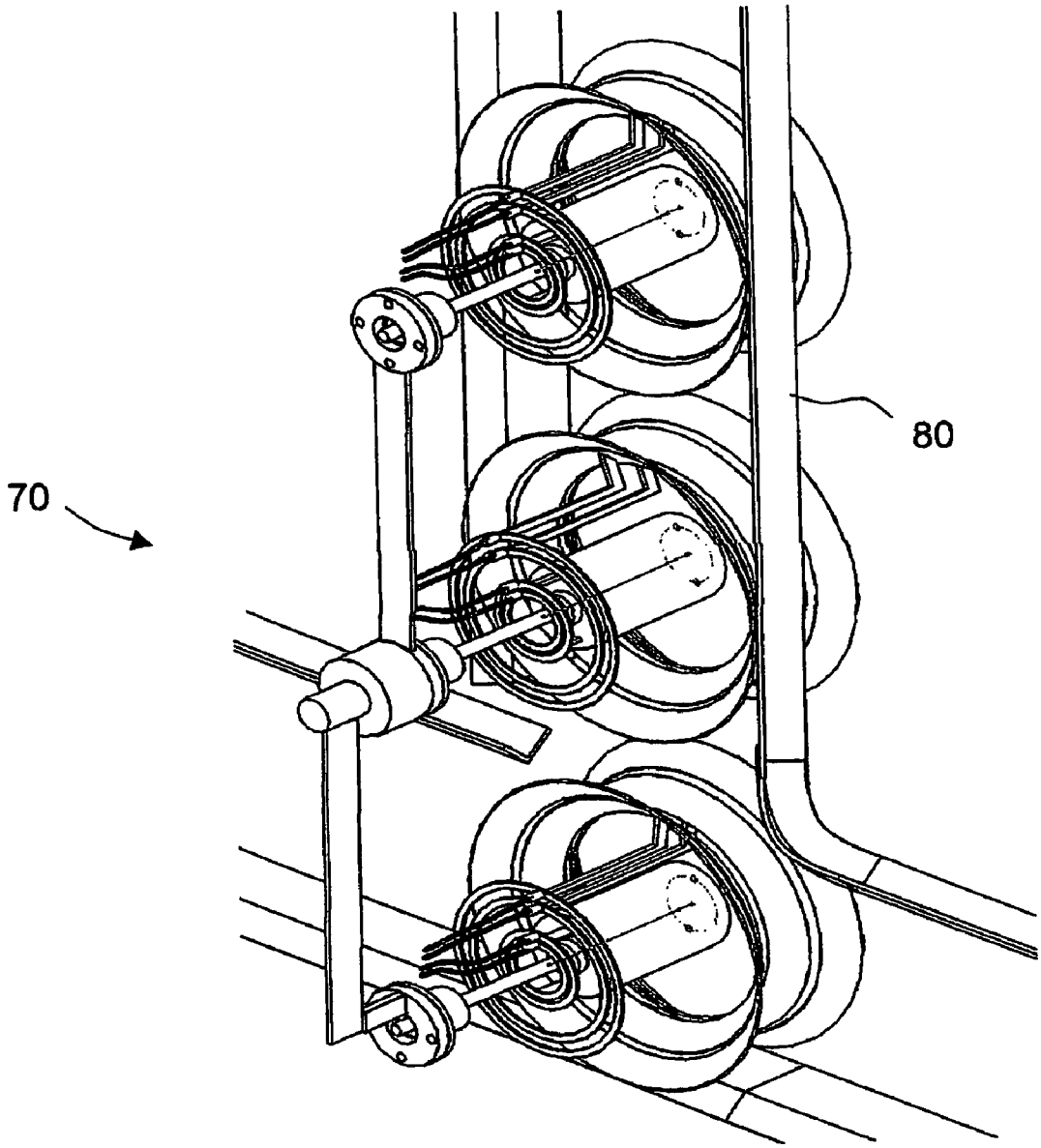
Figure 7D:
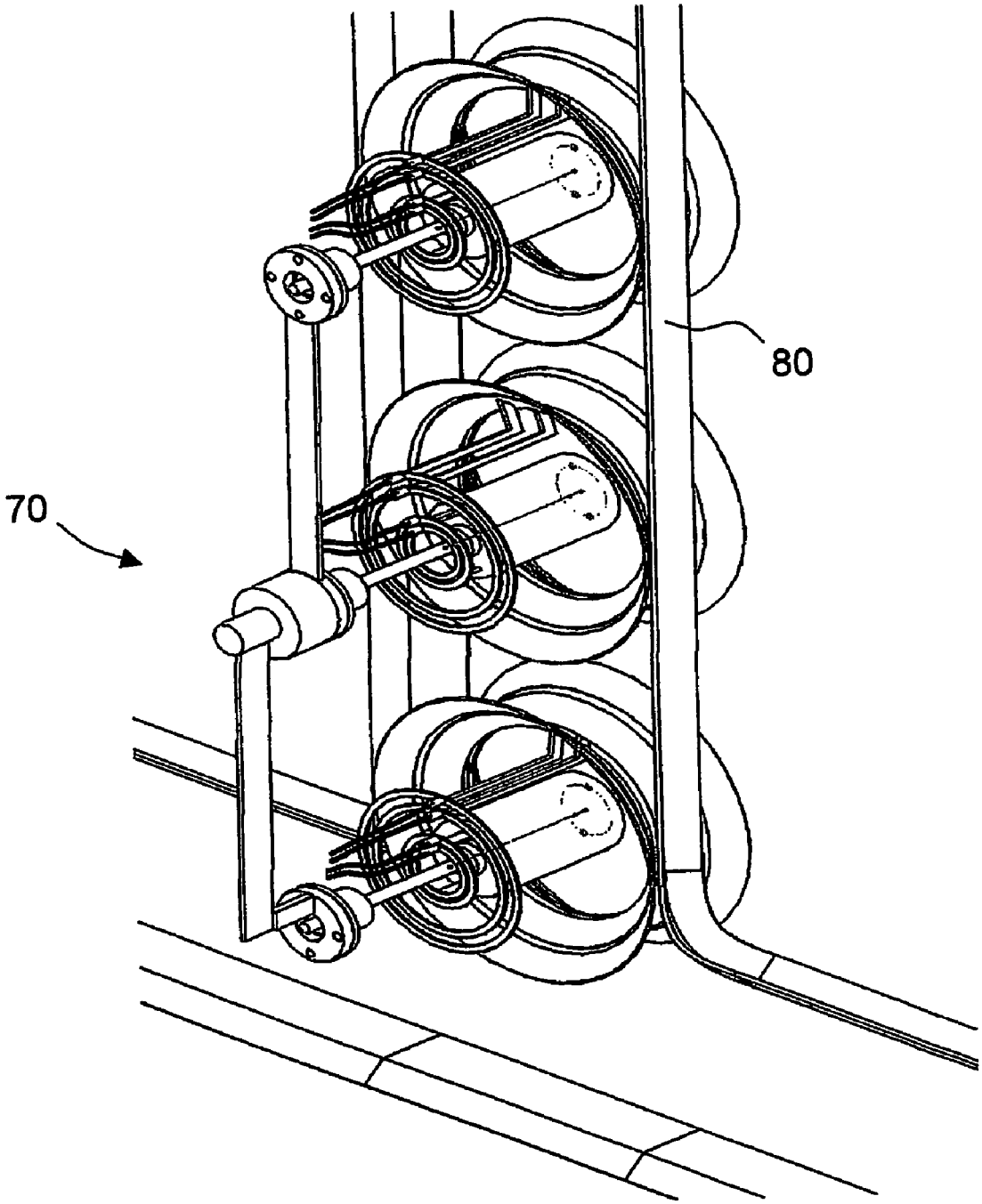
Figure 8:
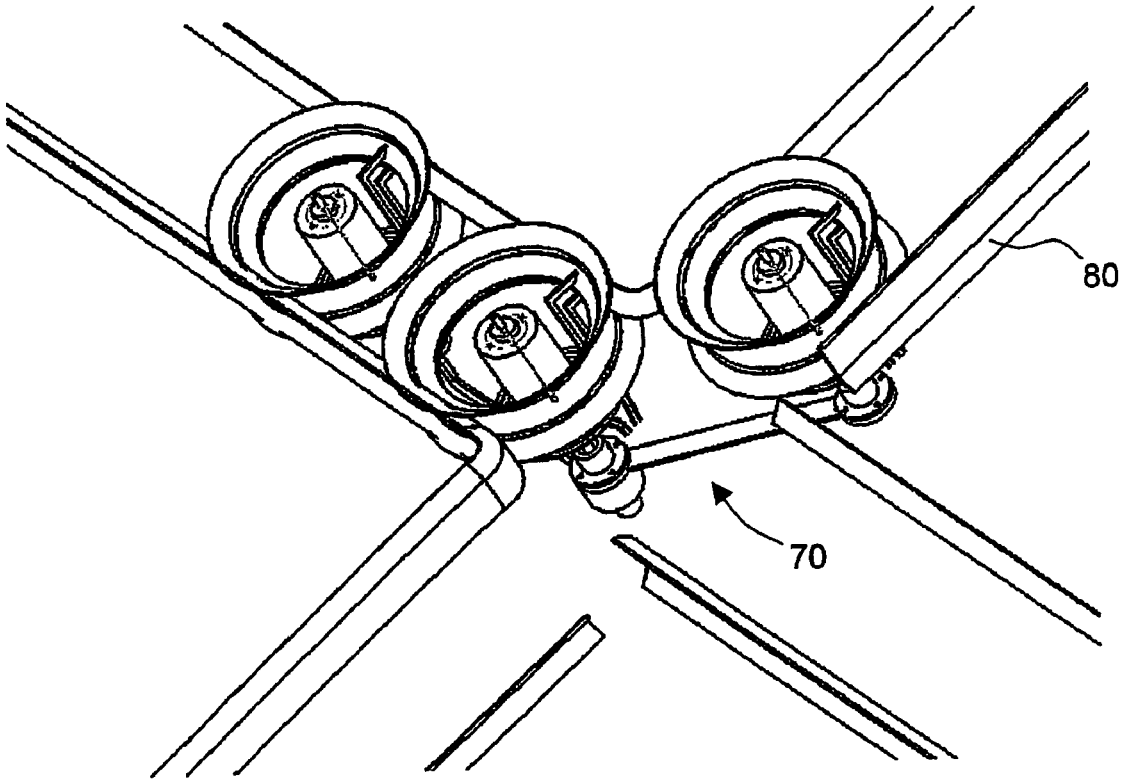
Figure 9A:
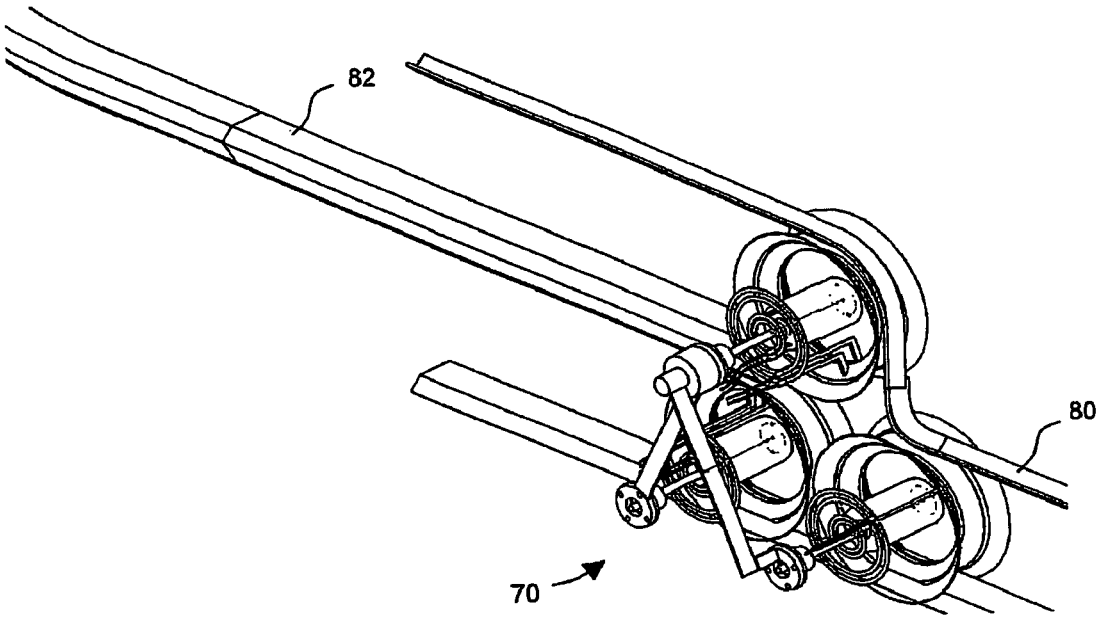
Figure 9B:
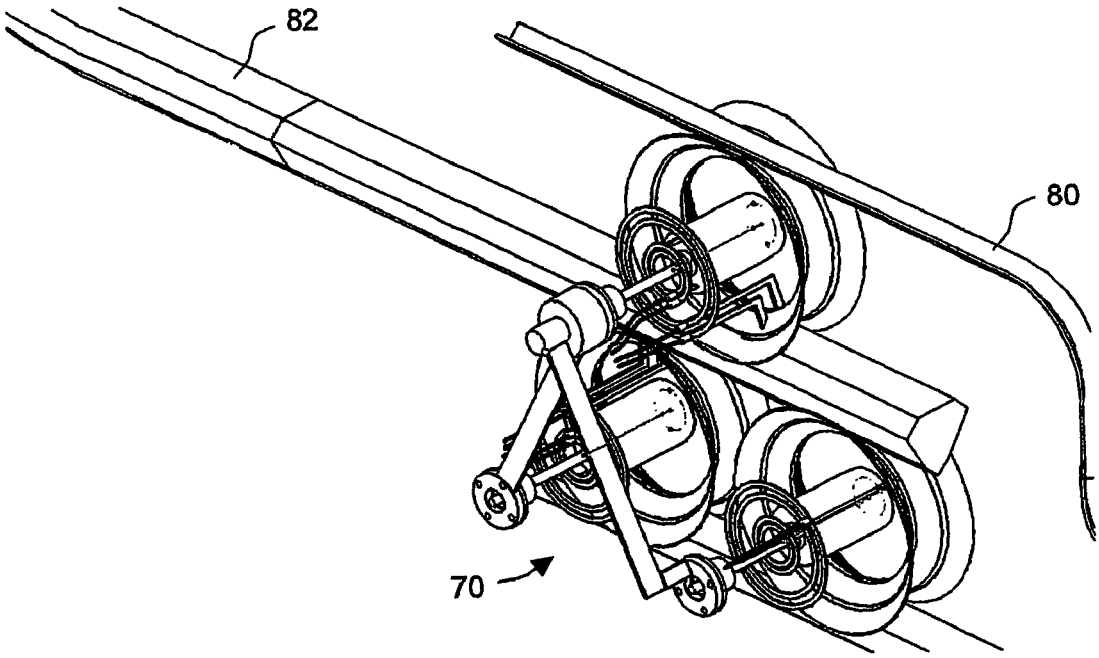
Figure 9C:
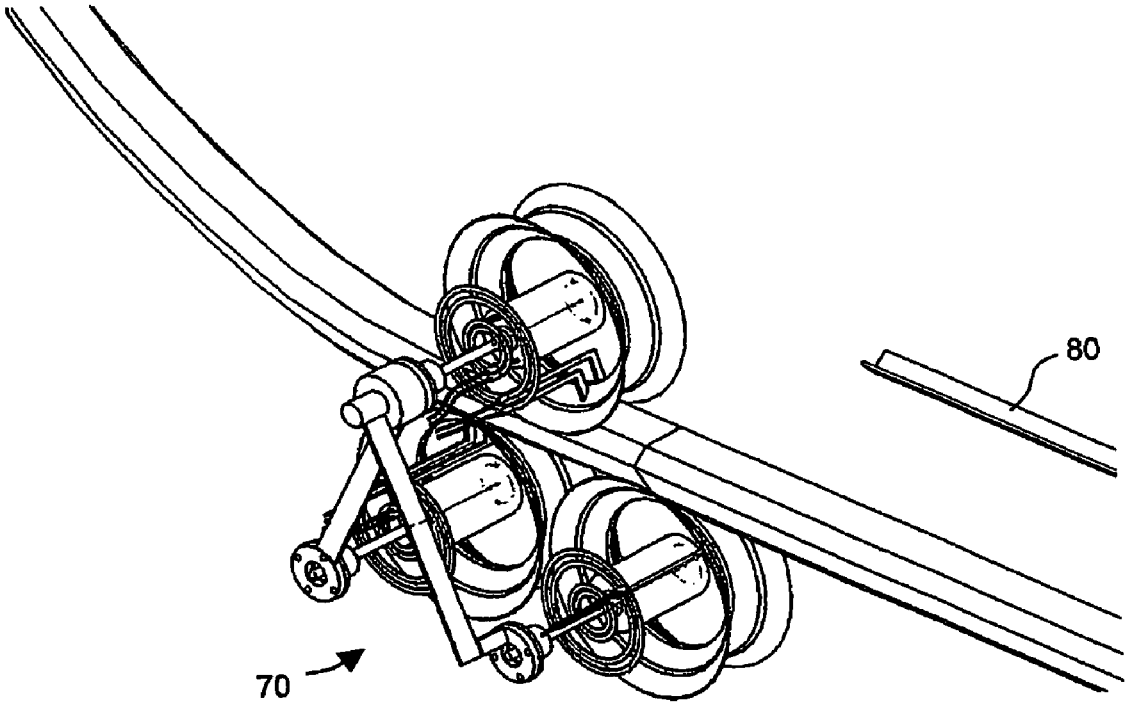

FIGS. 3A, 3B, and 3C are three detailed front perspective, cross-sectional and exploded views of the platform module, according to the invention;

FIGS. 4A and 4B are detailed views of conductive tracks;

FIGS. 5A, 5B, 5C and 5D are isometric views of embodiments of tracks and wheels interface configurations;

FIGS. 6A and 6B are schematic perspective illustrations of two and three module platform carriages;

FIGS. 7A, 7B, 7C and 7D illustrate four sequential views of steering steps of the carriage of FIG. 6A in a "T" track junction;

FIG. 8 illustrates maneuverability of a carriage in an "X" track junction;

FIGS. 9A, 9B and 9C illustrate three schematic sequential views of switching steps of a carriage from within a sleeve track to an open mono-track;

FIGS. 10A to 10E are isometric views of a platform module enclosure;

FIGS. 11A to 11G are views of the platform module with payload carrier stabilized by a reaction with the tracks, and FIGS. 12A, 12B, 12C and 12D illustrate flexible track installations.

DETAILED DESCRIPTION OF THE PREFERRED EMBODIMENTS

Figure 1:
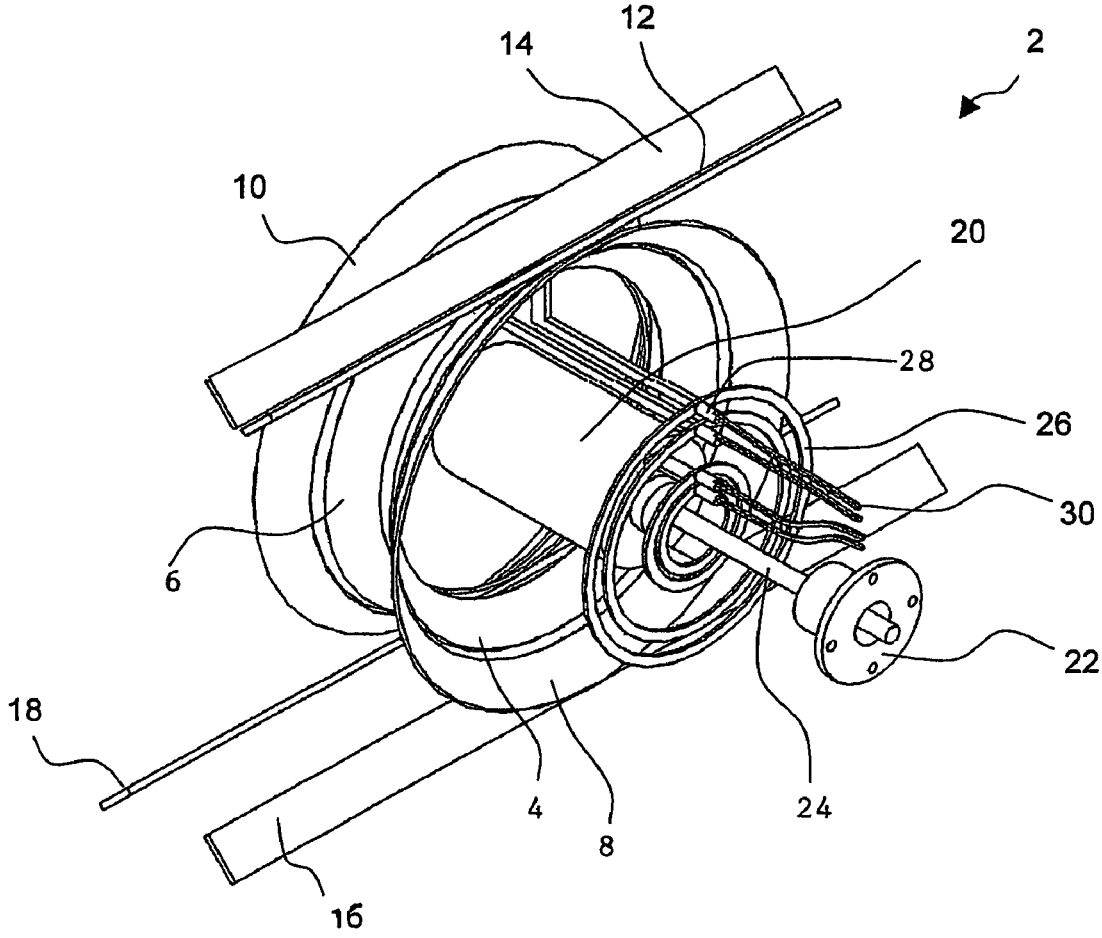

FIG. 1 is a schematic view of a simplified electro-mechanical principle of a differential propulsion mechanism, hereinafter vehicle or platform module 2. The platform module 2 comprises a number of concentric first wheels 4, 6, 8 and 10, captured in between the first tracks 12, 14, 16 and 18. The tracks 12 and 14 have conductive surfaces intended to provide continuous conductivity between power lines built in the tracks (as well as between the control and communication channels, that are not shown in FIG. 1) and the platform module 2, through the first wheels 4 and 6.

First wheel 10 is connected to a rotor of motor drive 20 and guided by track 18. First wheel 8 is freely rotating and guided by track 16. First wheels 4 and 6 are respectively guided by tracks 12 and 14. As long as the distance between the contact lines (that coexist in the same plane) of the platform's first wheels (4, 6, 8, 10) and the tracks (12,14, 16, 18) is kept within a certain range, the platform module will move stably on the track following the track curves, both, structured curves and those that are caused by external forces. To keep the distance between contacts within the allowed range, tracks 12 and 14 can be forced by springs (not shown in FIG. 1) in the direction of tracks 16 and 18 and thereby ensure close contact and higher traction forces between the wheels and the tracks. Alternatively, dynamic adjustments of the diameter of first wheels 4 and 6 may compensate for inaccuracy and for operating deformations, resulting from an increase in the above-mentioned distance.

One or more embedded driving motors 20, drive the first wheel 10 in one rotating direction, whilst the motor "stators" carried by the first wheel 6 rotate together with the first wheel 6 in an opposite rotating direction and provide the torque reaction needed for the propulsion of the platform module on the tracks. Therefore, beyond the standard requirement for balancing the rotor, it is also necessary to balance the stators.

The set of mutually counter-rotating elements of the platform module is basically an inherent differential mechanism. This fact constitutes a basis of the propulsion principle of a single axis wheel platform and enables high maneuverability of the platform module, including sharp turns. At high platform velocity, better platform stabilization can therefore be expected as a result of the "Gyro" effect. This fact may become crucial wherever high velocity transportation over flexible installations is applied.

Payload carrier 22 freely rotates on the motor and wheels shaft 24. Power is supplied to the payload from the conductive first tracks 12 and 14, through the conductive surfaces of the first wheels 4 and 6 and then through contacts between conductive wheel's rotating slip-rings contactors 26 (two outer rings) to two corresponding non-rotating contactors 28 and, in turn, though wires 30.

Figure 2:
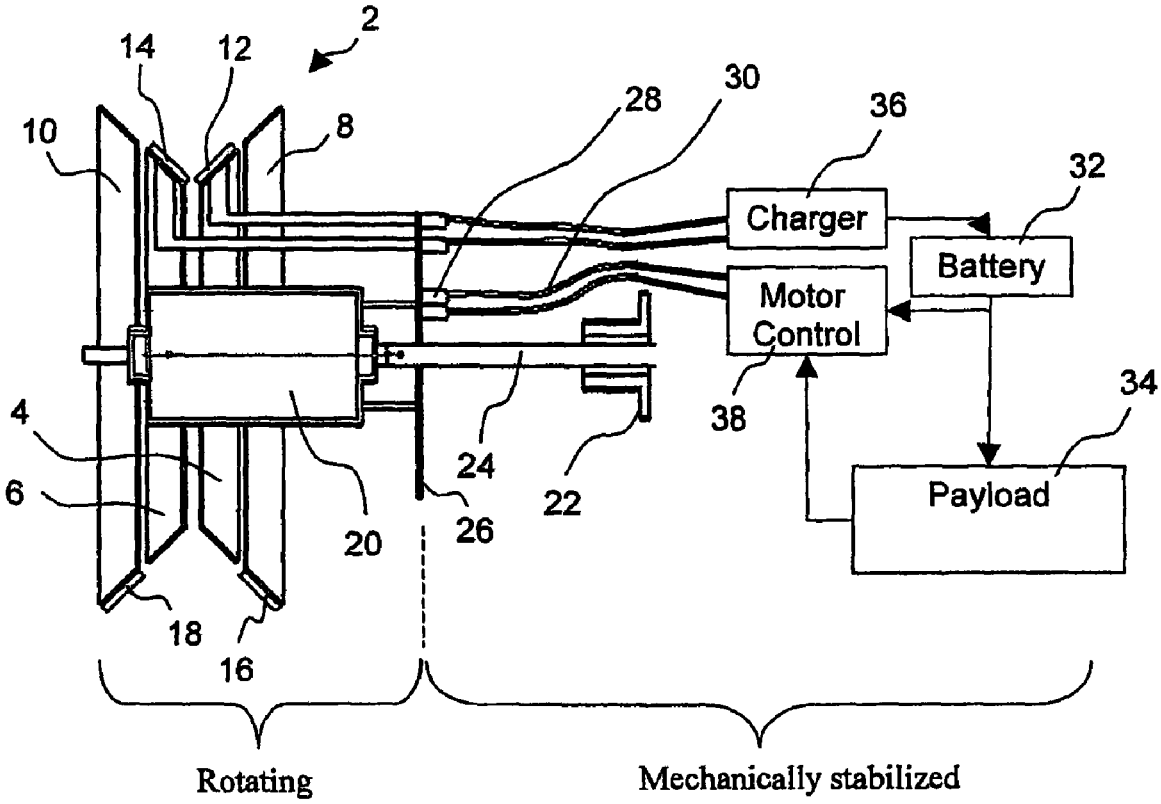

FIG. 2 illustrates a manner of applying a power supply to the motor drive 20, through the wires 30, contactors 28 and motor drive slip-rings contactors 26 (the two inner rings seen in FIG. 1). The battery 32 can be a part of the payload 34, as shown in FIG. 2, or alternatively, an internal part of the platform module 2, however, in this case, the battery should be balanced for rotation. Also seen are a battery charger 36 and a motor control 38.

FIGS. 3A and 3B show in detail a configuration of the first wheels with four related conductive slices/disks 4*a*, 4*b*, and 6*a*, 6*b*, two for power and two for communication, isolated by dielectric spacers. The shaft of the driving motor 20 allows first wheel 10 to be driven in one rotating direction whilst its "stator" (which is actually non-static) allows all other related first wheels (except first wheel 8, which rotates freely) to be driven in an opposite rotating direction and provides the torque reaction needed for a movement of the platform module. Therefore, beyond the standard requirement for the rotor balance, it is also necessary to balance the stator.

FIGS. 3B and 3C illustrate the payload carrier 22, supported by a double row of ball bearings 40, enables the payload to be stabilized regardless of the fact that all of the platform elements are rotating. For a high level of payload stabilization, platform carriage configurations, which will be described hereinafter, may be applied. Alternatively, for low speed—low stabilization applications, the payload can be stabilized by forming a reaction force between the payload carrier and the tracks, as illustrated hereinafter in FIGS. 11A to 11E and in FIGS. 12A to 12D. The payload carrier is provided with threads and/or holes 42 and at least one centering pin or similar centering mechanism for connecting to the payload structure, or to the platform module link beam (FIG. 6) and an electrical connector for the power and the communication lines of the payload. At the center of payload carrier 22 there is a hole for wires 30 that extend from the collector house 44 hosting the slip-rings contactors 28 (FIG. 1).

FIG. 3C is an exploded perspective view of the platform module. Motor and wheels shaft 24 allows by two ball bearings 48 to carry all of the rotating elements of the wheel assembly in such a way as to allow the driving motor (carried by the motor and wheels shafts 24) to be loaded by pure torque only.

FIGS. 4A and 4B are detailed views of first tracks 12 and 14 and the conductive tracks and wheels interaction areas, respectively. First tracks 12 and 14 are flexible multi-layer structures of thin flexible electrically insulating strips 50 and 52 and of thin spring metal leafs 54*a*, 54*b*, 54*c* and 54*d* acting as structure strengtheners, conductors and as continuous contacts. The flexible multi-layer structures allow wide range elastic deformation on its longitudinal axis whilst keeping the shape of its cross section unchanged.

Continuous contact between the conductive spring leafs 54*a* to 54*c* and the related conductive slices/disks 4*a*, 4*b*, 6*a* and 6*b* is achieved by elastic bending of the edges of the spring leafs 54*a* to 54*c* under certain pressure of the above mentioned wheels. To avoid fatigue and wear of the conductive spring leafs 54*a* to 54*c* and of conductive surfaces of slices/disks 4*a*, 4*b*, 6*a* and 6*b*, the major portion of the mechanical reactions is absorbed between the reaction strip 56 of the first tracks 12 and 14 and the reaction slices/disks 58 and 60 of the first wheels 6 and 4, correspondingly. Reaction slices/disks 58 and 60, preloaded by a set of axial springs, exploit their angular shape for increasing the effective diameter of its mechanical contact lines. By compensating for the distance variation between the tracks, improved traction forces can be achieved. Wherever high traction forces are required, cog-strips (not shown) can be integrated within the central slot of reaction strip 56 and next to the track 18, (FIG. 1) to provide positive gearing with the platform module cog-wheels 62 (FIG. 4B) and 64 (FIG. 3B), related to the first wheels 10 and 6, correspondingly. The switching from the friction traction to the positive cog-traction is done step by step (first 62 and then 64, or vice-versa) while exploiting the springiness of the distance compensating reaction slices/disks 58, 60 and/or by creating local springiness of the conductive tracks at the switching areas.

Figure 5A:
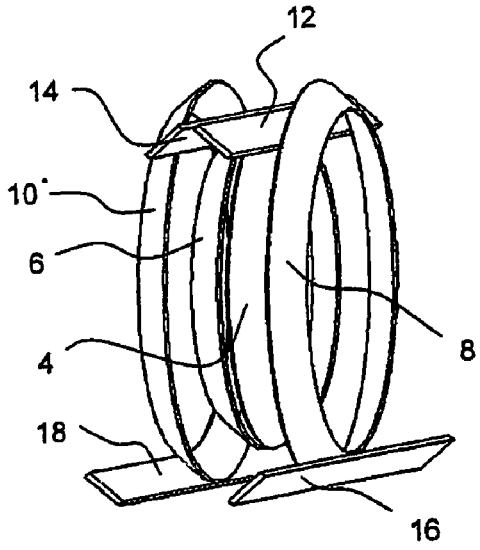
Figure 5B:
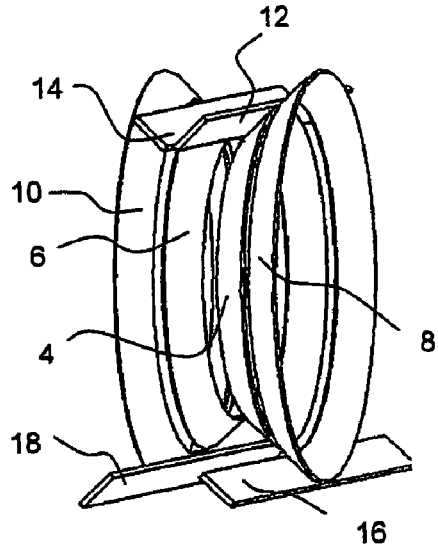
Figure 5C:
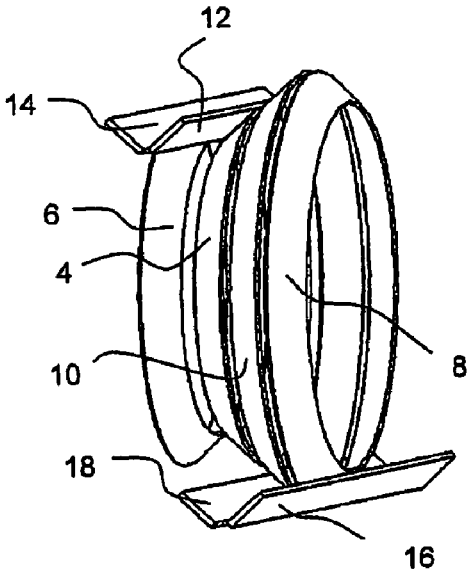
Figure 5D:
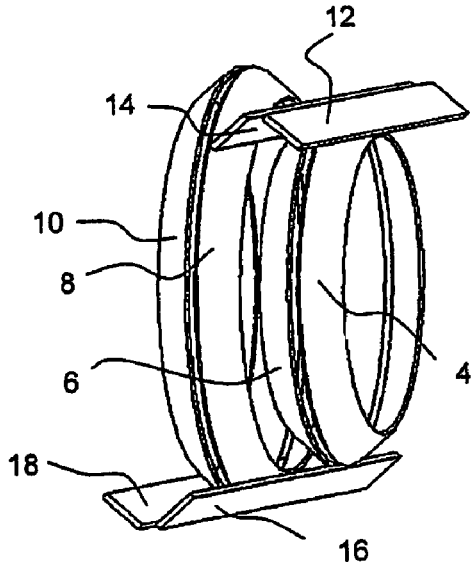

FIGS. 5A to 5D are schematic views of some additional basic tracks and wheels arrangements. Basically there are two types of main arrangements—symmetric (FIGS. 5A and 5B) and asymmetric (FIGS. 5C and 5D). The track cross-sections are not limited to those illustrated hereinbefore. There are other possibilities to form the track cross-section, such as conical, rounded, elliptic, etc.

FIGS. 6A and 6B are schematic views of platform carriages 70. Platform carriages allow, beyond the functionality of the platform module, for a higher level of payload stabilization and carrying capacity, to reach higher velocities and, at three module carriage configuration of FIG. 6B, to steer the platform in the track.

The platform carriage 70 consists of two or more platform modules interconnected by its payload carriers 22 by link beams 72 or spring leafs 74. For steering capabilities of a three modules carriage, the first platform module should be connected through the link beam 72 to the stator of angular actuator 76 that is carried by the middle platform module payload carrier, whilst the rotor 78 of the angular actuator 76 should be connected through the spring leaf 74 to the payload carrier 22 of the third platform module. The purpose of spring leaf 74 is to allow preloading (by angular actuator 76) prior to the turning point of the junction in order to reach better flexibility in the steering control.

Platform carriage of two modules enables heavier payload, faster movement along the tracks and better stabilization of the payload relative to the tracks. Platform carriage of three modules enables additional maneuverability within the network 80, by changing the direction at different types of junctions. A platform carriage of three platform modules may have a simplified middle platform module if it does not require a motor drive.

The schematic views of FIGS. 7A to 7D are sequential steps of a three module platform carriage 70 maneuverability in a "T" track junction network 80.

FIG. 8 is a schematic view of a three modules platform carriage 70 maneuverability in an "X" track junction network 80.

The schematic views of FIGS. 9A, 9B and 9C are sequential steps of three module platform carriage 70, switching from within a sleeve track network 80 to an open mono-track 82.

The track network 80 provides an infrastructure for power, communication and transportation for platforms and payloads that are carried by the platforms on the network. Moreover, the track network can provide a protected channeling place for external, nearby, users. The track modules that build the network have individual serial codes that can be read and identified by the platform modules or platform carriages. Therefore, the platform controller can detect the carriage position in a real time, and can accurately place the platform at any location on the network.

Figure 10A:
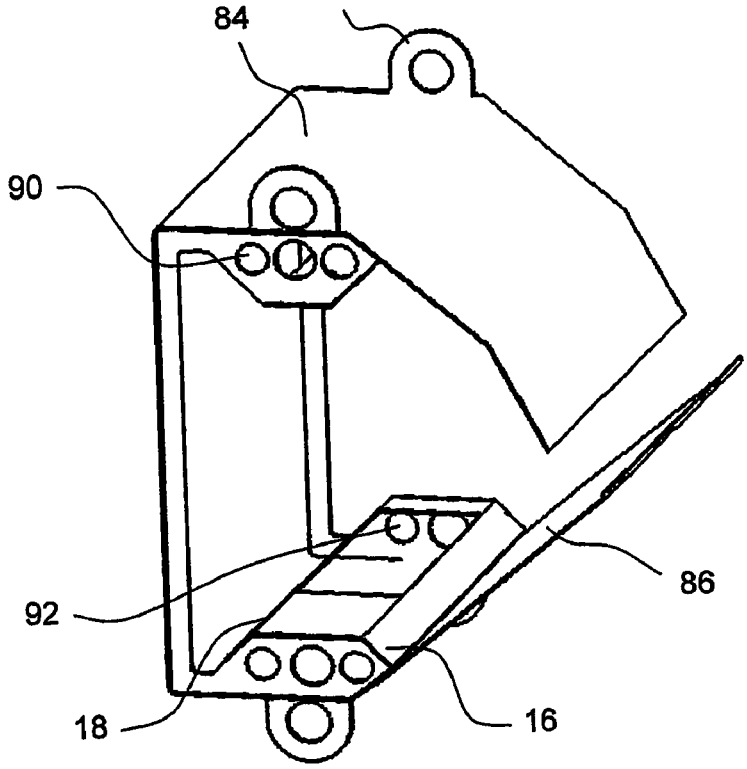
Figure 10B:
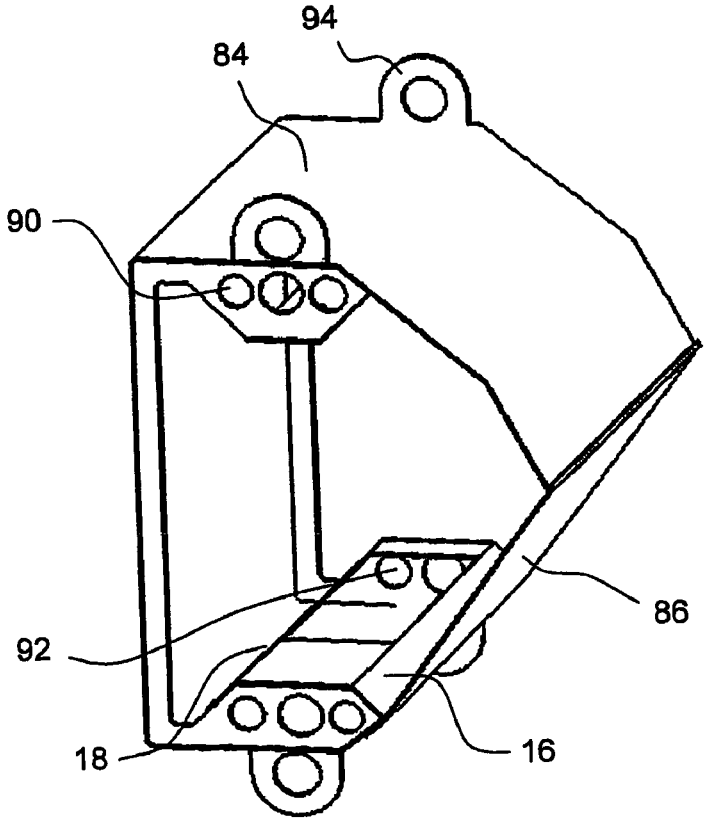

FIGS. 10A and 10B are perspective views of a protection enclosure 84 with built-in tracks 16 and 18. The elastic wing 86 of the enclosure 84 is attached to the module skin and is normally closed to ensure cleanliness of the enclosure's interior and to avoid any kind of safety risk to the platforms and to the environment. The elastic wing 86 is automatically pushed out by the forces of wing opener wheel 88 (FIGS. 3A and 3B) and by the outer side of the wheel 8 that acts close to the base of the wing 86. These two forces will create a "continuous" local notch to avoid any kind of friction between the payload carrier 22 and the protecting enclosure 84. The notch will close itself right after the platform module passed by. Further seen in the figures are channels 90 for power and communication cables and channels 92 for users cables, as well as hanging lugs 94.

Figure 10C:
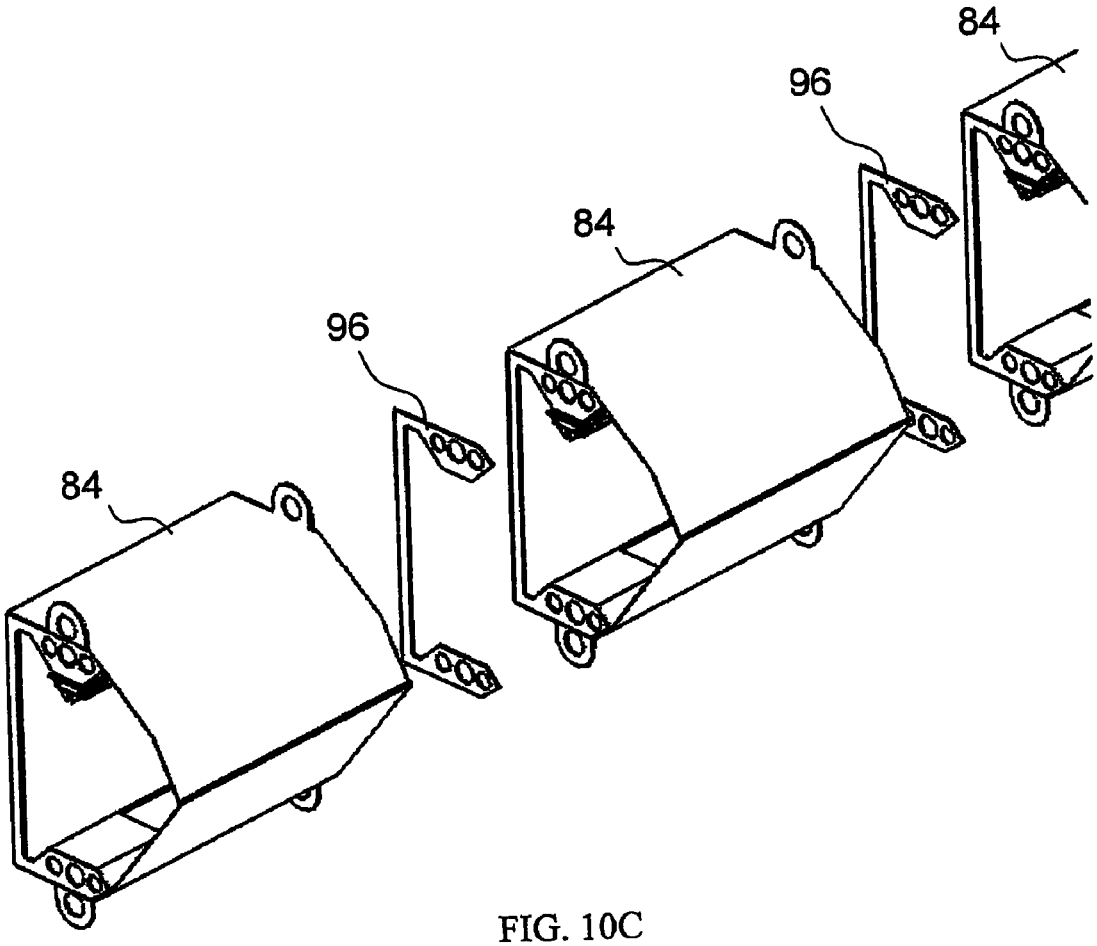
Figure 10D:
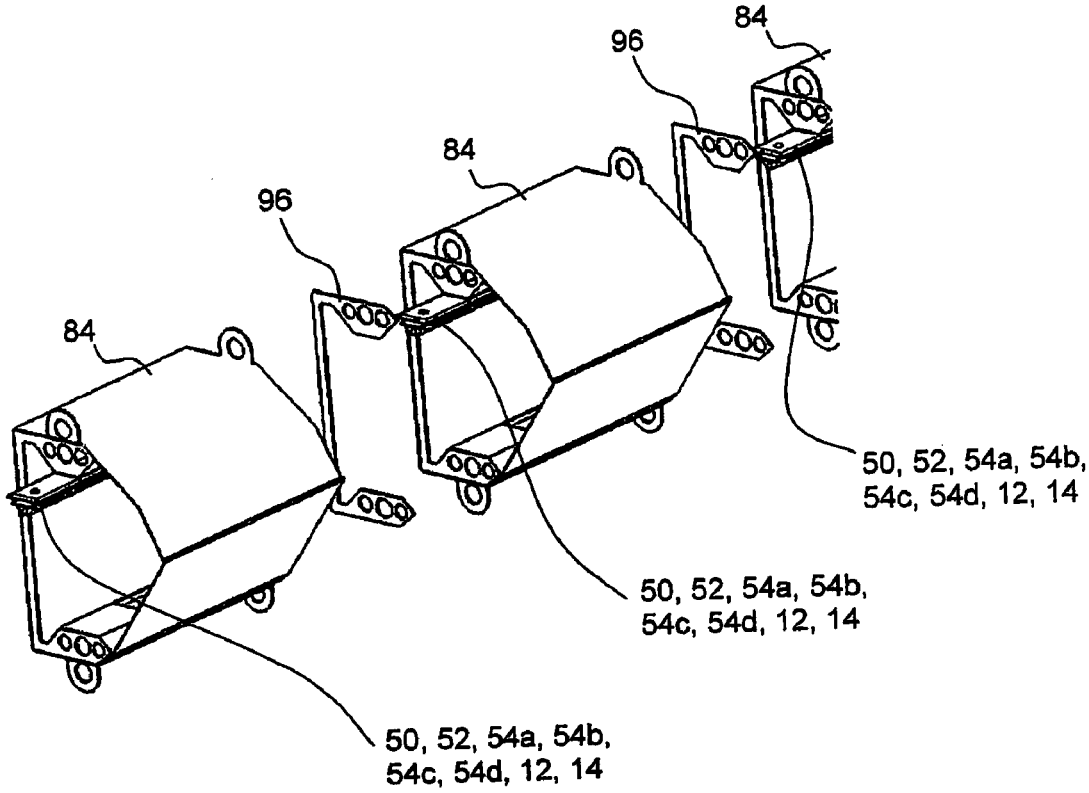
Figure 10E:
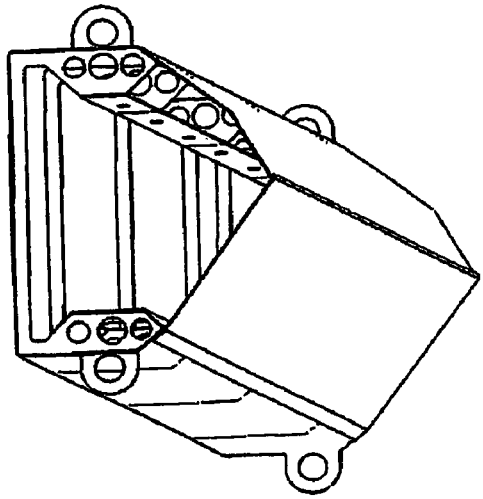

FIGS. 10C and 10D are perspective views of interconnected protecting enclosures 84. Two parameters defining the rigidity level of the enclosure assembly are the flexibility level of a sealer 96 and the installation configuration of the conductive tracks (namely, of overlapping versus non-overlapping). A low-level rigidity of the enclosure assembly can be achieved by applying short enclosure modules 84, a very flexible sealer 96, with no overlapping of the first tracks 12, 14 (FIG. 10C). For this configuration it is proposed to use two carrying lugs 94 for hanging on suitable cables. With the use of overlapping first tracks 12, 14 (FIG. 10D), higher rigidity is achieved for smooth movement of the platform carriages. Furthermore, for rigid installations it will be advantageous to assemble longer module enclosure (FIG. 10E).

Other types of modules (curved, angled, junctions, end elements and mono-track) can be derived from the above-described embodiments. Also, for the rigid or semi-rigid tracks, illustrated in FIGS. 10A to 10E, a symmetric arrangement was adopted. For the flexible tracks, illustrated hereinafter in FIGS. 12A to 12D, an asymmetric arrangement was adopted.

An embodiment of platform module 2 where the payload is carried and stabilized by a reaction force between the carrier 22 and the tracks (of both flexible and/or rigid type), according to the present invention, is illustrated in FIGS. 11A-11G, wherein two concentric first wheels 6 and 10 can be seen, delimited in between the first tracks 14 and 18, respectively. The first tracks 14 and 18 are made of round flexible conductive wire/cable, e.g., such as that used in high voltage electrical upper installations or an equivalent cross-section conductive rigid bar, to form conductivity between the stationary power source/supply and the platform module energy pack, (as well, between the control and communication center and the platform, via conductive surfaces of the first wheels 6 and 10).

Figure 11A:
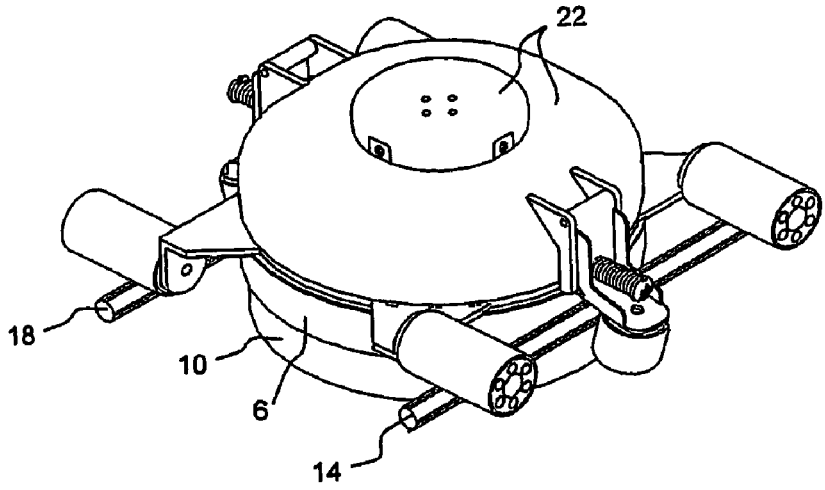
Figure 11B:
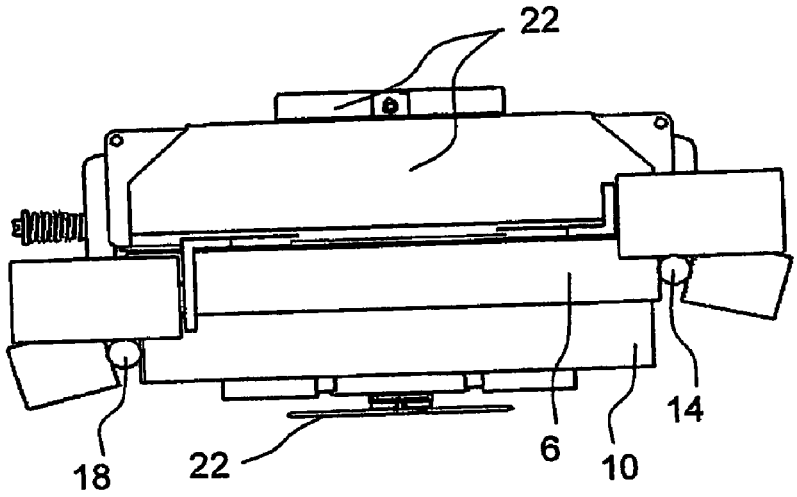
Figure 11C:
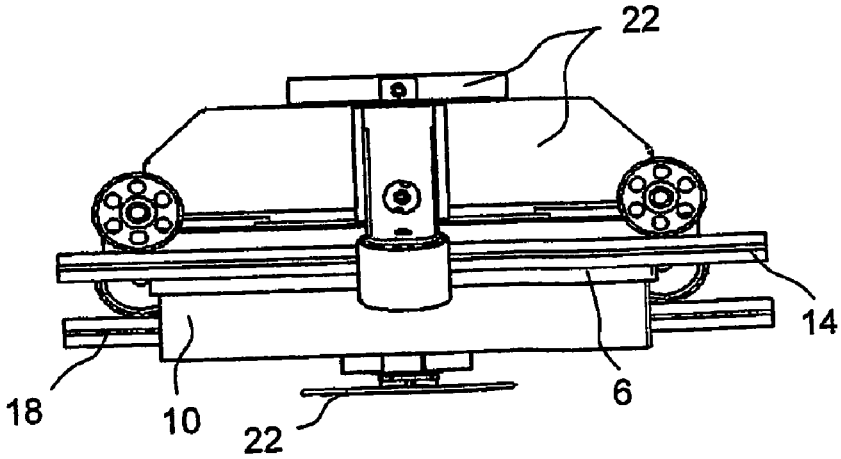
Figure 11D:
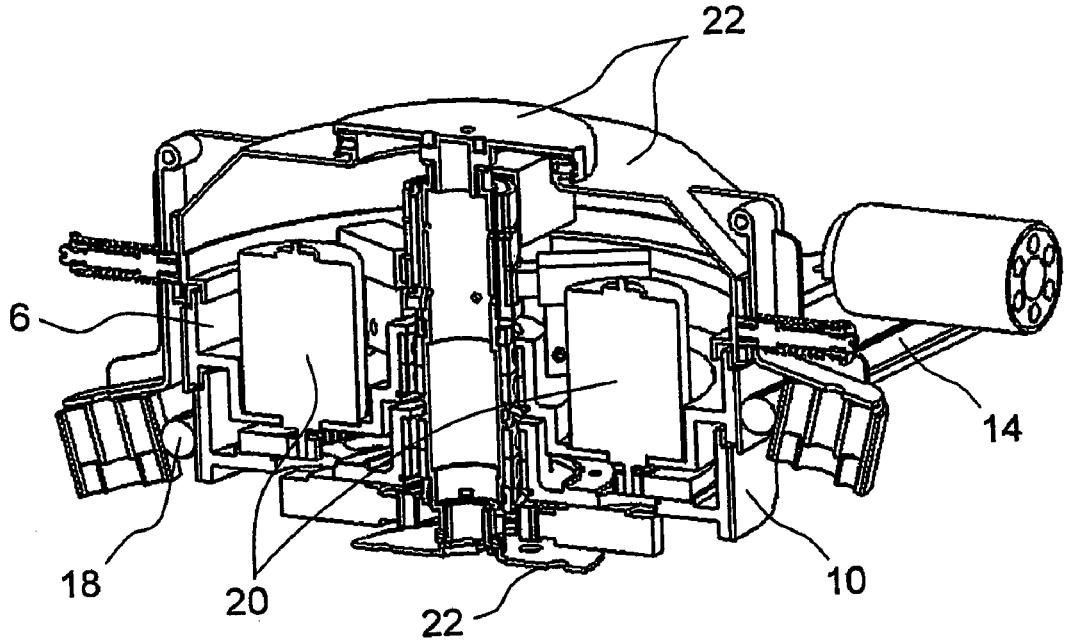
Figure 11E:
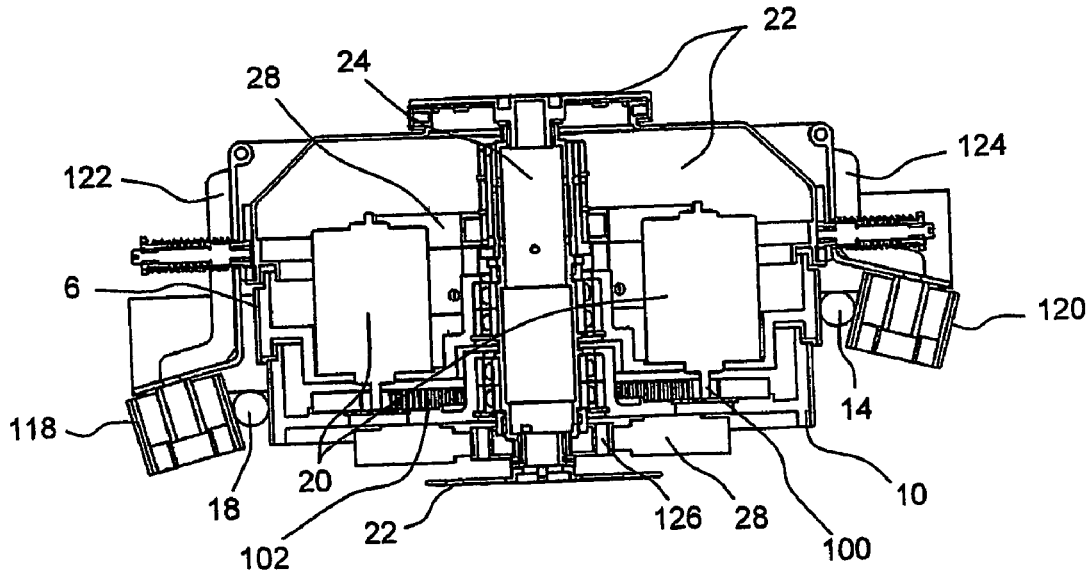
Figure 11F:
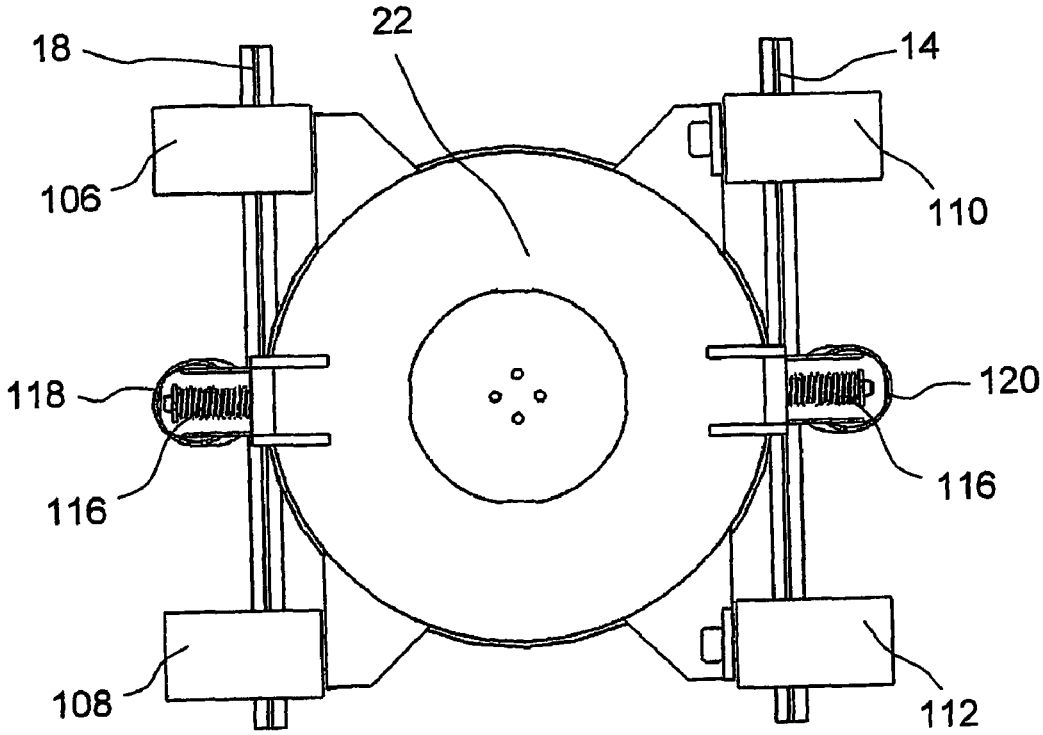
Figure 11G:
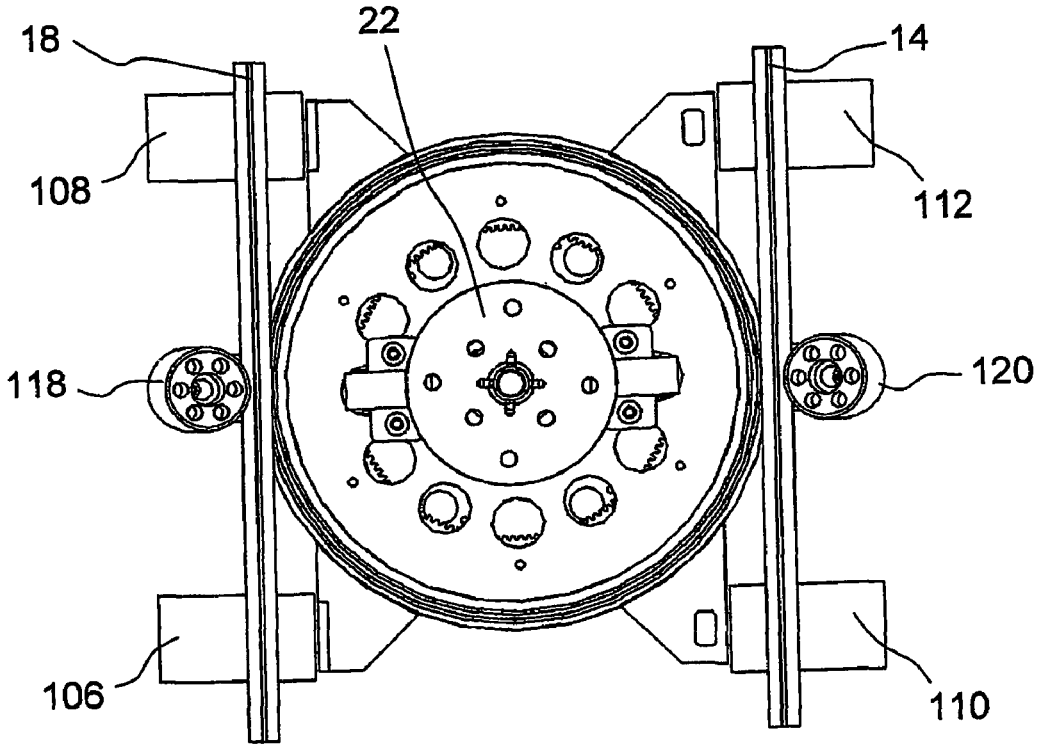

In FIGS. 11D and 11E there is seen the first wheel 10 driven on the first track 18 by the rotor shaft 100 of motor drives 20 through the mechanical transmission 102 (the transmission being effected by a small wheel attached onto the rotor shaft 100 and big wheel meshed with the small wheel). First wheel 6 counter-rotates on first track 14, as it carries the stators of motor drives 20.

The payload is carried and stabilized on the first tracks 18 and 14 by a carrier 22 (FIGS. 11A and 11B) interacting with the tracks with at least three stabilization wheels. In the arrangement shown in FIG. 11F, there are two stabilization wheels 106 and 108 traveling on the track 18 and stably attached to the carrier 22 and there is at least one stabilization wheel (in the Figures are shown two stabilization wheels 110 and 112) traveling on the other track 14. At least three stabilization wheels allow stabilizing a single plane over two non-parallel tracks, as it may occur with flexible and rigid tracks.

To keep the distance and the traction force between the first wheels 6 and 10 and the tracks 14 and 18, respectively, within an allowed range, two or more preloaded springs 116 and limit wheels 118 and 120 push the track 14 in a direction of track 18, to avoid slippage between the first wheels 6 and 10 and the tracks 14 and 18. The two or more preloaded limit wheels 118 and 120 are carried by arms 122 and 124 that are rotatable about a single axle of carrier 22.

In this arrangement, tracks 14 and 18 are captured within the area delimited by the first wheels 6 and 10, limit wheels 118 and 120 and stabilization wheels 106, 108 and 110, 112, respectively, thereby maintaining the coupling between the platform and the tracks under high dynamic loads.

In this arrangement, payload carrier 22 also acts as a motor and wheel shafts 24 (FIGS. 1 and 2) and provides coupling capability on both sides of the differential propulsion mechanism. The power is supplied to the platform energy pack (not shown) from the conductive first tracks 14 and 18, through the conductive surfaces of the first wheels 6 and 10, then via the two lower rotating contactors 28 slipping over two corresponded non-rotating conductive slip-rings 126 attached to the carrier 22 and finally through wires 30 (see FIG. 2) to a battery, optionally through a charger. Electric drive motors 20 are then fed by a motor controller via two upper rotating contactors slipping over two corresponding non-rotating conductive slip-rings attached to the carrier 22.

Whenever a rigid track is not applicable or not cost-effective because of the terrain conditions, e.g., terrain obstacles which may increase the cost of rigid track installation and/or it is an advantage to have the payload elevated and moving well above the terrain for better area coverage, a flexible track can be applied.

Flexible track illustrated in FIGS. 12A to 12D can be made of standard round electrical wires/cables, or alternatively, of lifting cables or any other flexible materials capable of bridging over two remote points, e.g., pillars 128. The strength of the flexible track should be significantly higher than the tension force as a result of self weight, platform weight, dynamics, and environmental influences, e.g., wind, snow, ice, etc. The installation of electrical wires/cables on the pillars, or on the other support elements, can be based on standard high-voltage installation techniques and elements, e.g. isolators 130, or alternatively it can be based on special connection elements shown in FIGS. 12C and 12D.

Figure 12A:
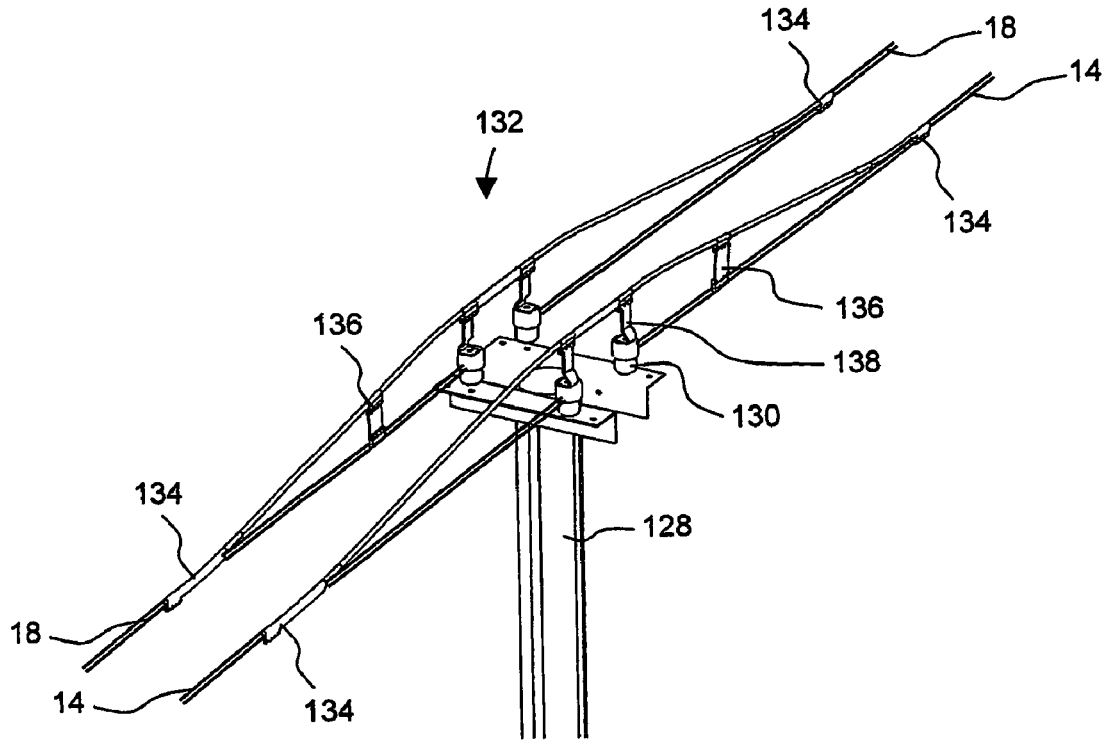
Figure 12B:
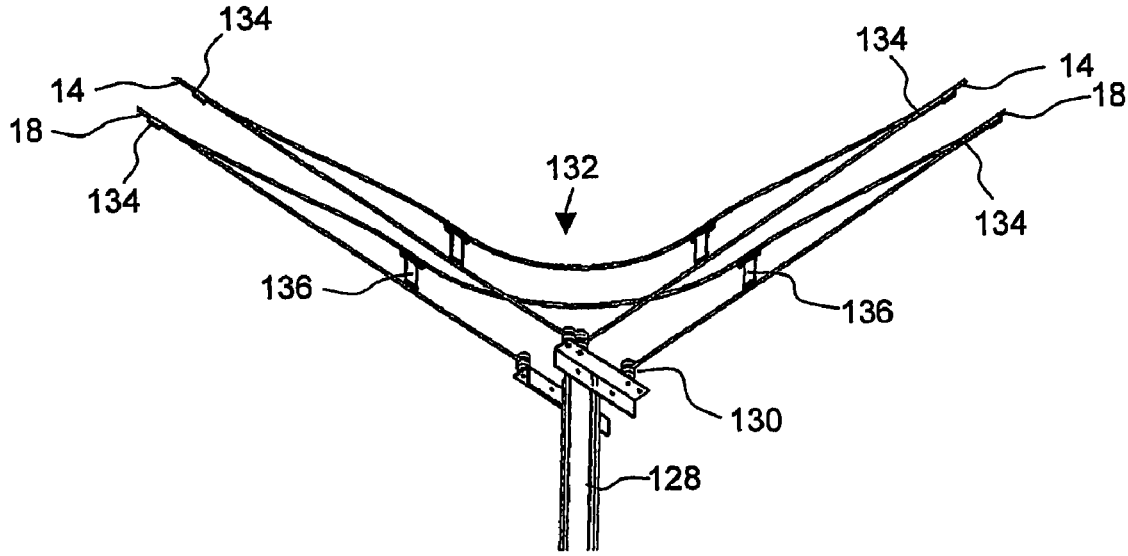
Figure 12C:
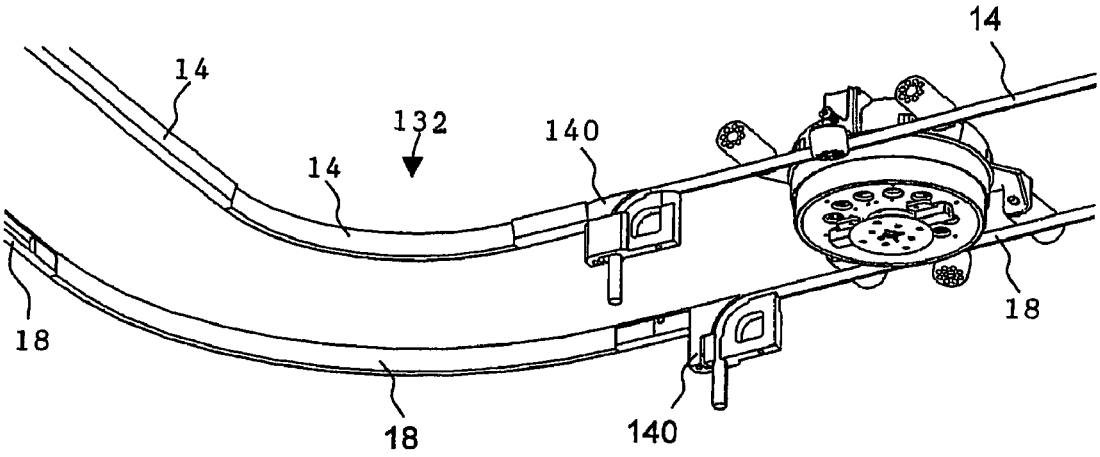
Figure 12D:
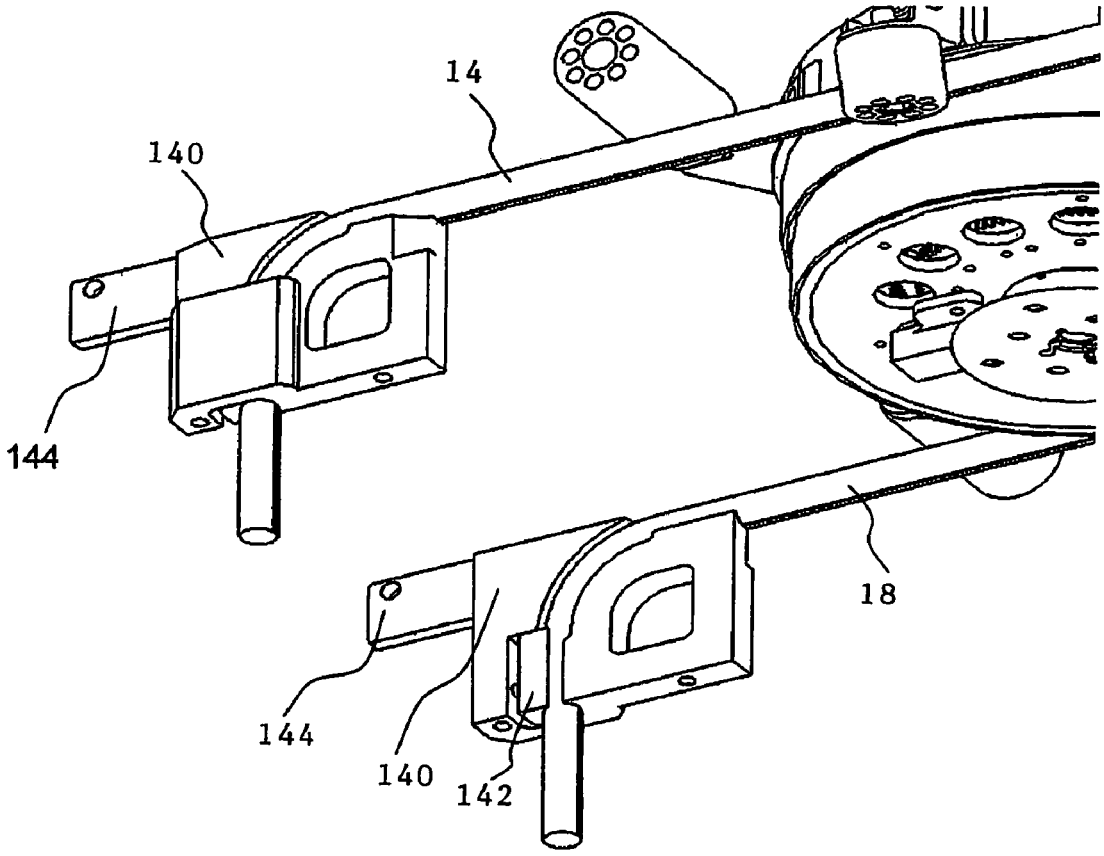

In order to facilitate transportation continuity of the payload, carried by a carrier 22 over a pillar 128 and/or over the other support structure, a rigid transportation bridge 132 with an adjustable turn angle and turn radius is placed in between the flexible tracks connected to the pillar and/or to any other support element. FIGS. 12A to 12D illustrate two basic configurations of the transportation bridge 132, i.e., in floating and fixed configurations. The access and egress elements 134 of the floating transportation bridge are kept in alignment with the flexible tracks by the alignment elements 136. The elements 134 redirect the carrier 22 and the differential propulsion mechanism carried by the carrier 22 from the flexible track to the rigid track of the bridge 132, and vice versa. The bridge 132, carried by elements 134, 136 and, optionally by elements 138, floats freely in between the flexible tracks to avoid stressing of the bridge/tracks. The access and egress elements 140 of the fixed transportation bridge shown in FIGS. 12C and 12D are attached at least indirectly to pillars or any other support structure. Access and egress elements 140 of the fixed transportation bridge provide a linear and smooth passage from the flexible track to the rigid track coupled to said element by an adaptor 144, and vice-versa. After the tensioning of the flexible track by an external tensioning device (not shown), the flexible track is held by a fastener 142 and/or any other fastening element attached to the access and egress element 140.

Whenever unique physical properties are required, flexible track can be chosen from a group of non-conductive materials, based on the fact that the platform interior energy pack can independently feed the system for some period of time.

Whenever higher level of payload stabilization is required, the payload can be transported on separate track(s), carried by ultra-light-weight-non-motorized suspension (in order to prevent the generation of vibrations) towed by the platform module moving on other tracks (not shown). To avoid transmission of vibrations from the motorized towing platform and from its tracks to the non-motorized towed suspension and payload and to its track(s), the payload suspension can be towed through the vibration-absorbing link.

Rigid track configuration can fit continuous rigid-basis installations, e.g., on walls and ceiling of buildings. Semi-rigid track configuration can be suitable for bridging over openings, e.g., between two buildings, or for non-stable structures such as fences. A flexible track configuration is suitable for deployments where there is insufficient physical infrastructure to support the track over the long lines.

The basic element of all of the above-described track configurations is a straight element. For changes in the direction of the track, curved elements can be applied, e.g., enclosures shaped to a desired angle or equivalent. For rigid or semi-rigid configurations, elements for connecting three or four tracks at a single junction can be applied. It enables a platform carriage to change tracks whilst maintaining the continuity of the power and communication lines to all connected tracks, via bypass lines, embedded in the elements.

For all tracks configurations, there are sufficient end elements that can be closed at the end of a track line, or open at points where the platform carriages are loaded or removed from the track network. It also enables easy access to the power and communication lines.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A differential propulsion mechanism comprising:

two or more concentric and mutually counter-rotating first wheels, mutually reacting and balancing the torque of a motor drive interacting with said wheels;

said motor drive having a stator attached to one of said first wheels to power a first wheel over a first track;

said motor drive having a rotor coupled to a mechanical link, at least indirectly connecting said rotor with at least one second of said two or more first wheels to power said second wheel over a second track, and a concentric connecting device affixed for coupling a payload thereto or for coupling the mechanism itself to another device.

2. The mechanism as claimed in claim 1, wherein said mechanism is delimited, stabilized and propelled in between two or more rigid, semi-rigid or flexible tracks made of conductive or non-conductive materials.

3. The mechanism as claimed in claim 1, wherein said motor drive is one or more electric motors with direct link or with a reduction transmission.

4. The mechanism as claimed in claim 3, wherein said electric motor is at least indirectly fed by an integral battery pack attached to the stator(s) and/or to the wheel carrying the stator(s).

5. The mechanism as claimed in claim 3, wherein said electric motor is at least indirectly fed by a battery pack attached at least indirectly to said connecting device.

6. The mechanism as claimed in claim 3, wherein said electric motor is at least indirectly fed from the tracks via conductive surfaces of said first and/or stabilization wheels, through at least one slip-ring contactor.

7. The mechanism as claimed in claim 1, wherein said first wheels are attached to the first tracks by preloading at least one of said first wheels or first tracks, thus providing traction force.

8. The mechanism as claimed in claim 1, wherein at least two of said first wheels are meshed with at least two of said first tracks correspondingly, thus reducing the possibility of slippage.

9. The mechanism as claimed in claim 1, wherein said mechanism is carried and stabilized by a payload carrier interacting with said tracks.

10. The mechanism as claimed in claim 9, wherein said carrier has at least three fixed wheels, disposed on the tracks to stabilize the payload in a single plane over two non-parallel tracks.

11. The mechanism as claimed in claim 1, wherein said connecting device is interconnected with one or more further mechanisms to provide improved carrying capacity and/or payload stabilization.

12. The mechanism as claimed in claim 1, wherein said first tracks are attached to the first wheels by preloading at least one of said first wheels or first tracks, thus providing traction force.

* * * * *